US008336126B2

(12) United States Patent
Baumoel

(10) Patent No.: US 8,336,126 B2
(45) Date of Patent: Dec. 25, 2012

(54) UNIVERSALLY INSTALLABLE HANDS FREE TOILET SEAT LIFTER/LOWERER

(76) Inventor: Joseph Baumoel, Wellington, FL (US)

( * ) Notice: Subject to any disclaimer, the term of this patent is extended or adjusted under 35 U.S.C. 154(b) by 56 days.

(21) Appl. No.: 12/945,224

(22) Filed: Nov. 12, 2010

(65) Prior Publication Data

US 2011/0119819 A1 May 26, 2011

Related U.S. Application Data

(63) Continuation-in-part of application No. 12/557,071, filed on Sep. 10, 2009, now Pat. No. 7,917,973.

(51) Int. Cl.
*A47K 13/10* (2006.01)

(52) U.S. Cl. ..... 4/246.1

(58) Field of Classification Search ..... 4/246.1–246.5
See application file for complete search history.

(56) References Cited

U.S. PATENT DOCUMENTS

| | | | | |
|---|---|---|---|---|
| 7,636,956 | B1 * | 12/2009 | Doucet | 4/246.1 |
| 2006/0242755 | A1 * | 11/2006 | Lohss | 4/246.1 |
| 2007/0056084 | A1 * | 3/2007 | Watt et al. | 4/246.1 |

* cited by examiner

*Primary Examiner* — Huyen Le
(74) *Attorney, Agent, or Firm* — F. Chau & Associates, LLC

(57) ABSTRACT

An apparatus mounted to a toilet is configured to lift and lower a seat assembly of the toilet. The apparatus includes a motion sensor that outputs a detection signal in response to motion, a motor driving unit, a motor, a first gear, a second gear interfaced with the first gear, an output shaft connected to a clutch coupled to a lever exiting the apparatus, a wire rope wrapped around hubs of the second gear and the output shaft, and a micro-controller. The motor driving unit is configured to drive a shaft of the motor in a clockwise or a counterclockwise direction based on receipt of a direction signal. The microcontroller is configured to send the direction signal to the motor driving unit based on the detection signal.

19 Claims, 29 Drawing Sheets

Outer Case

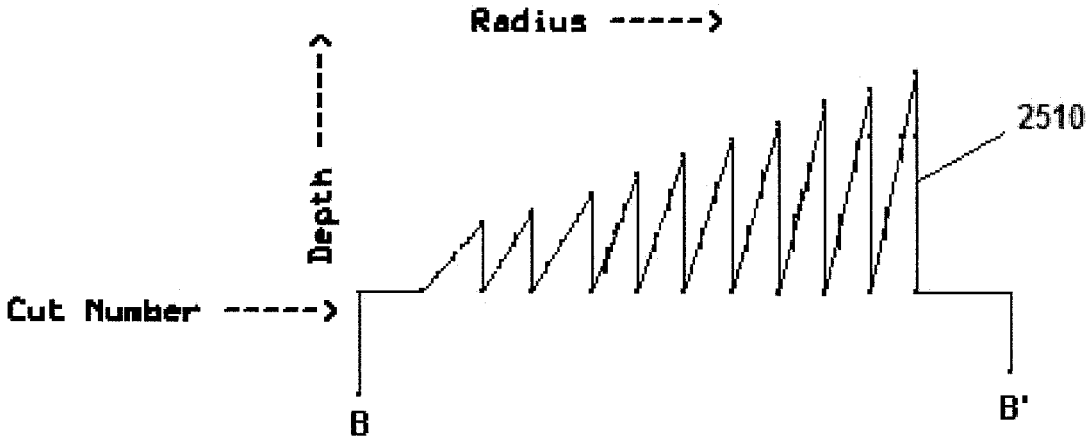
FIG. 25
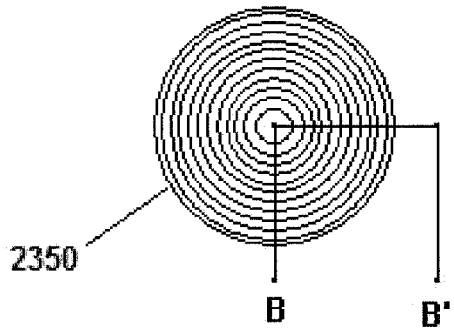

UNIVERSALLY INSTALLABLE HANDS FREE TOILET SEAT LIFTER/LOWERER

CROSS-REFERENCE TO RELATED APPLICATIONS

This application is a Continuation-in Part of U.S. application Ser. No. 12/557,071 filed on Sep. 10, 2009 now U.S. Pat. No. 7,917,973, which is incorporated by reference herein in its entirety.

BACKGROUND OF THE INVENTION

1. Technical Field

The present disclosure relates to a hands free system for lifting and lowering a toilet seat.

2. Discussion of Related Art

Public restrooms may be used by thousands of people daily and bacteria flourishes easily in these damp, moist environments. Restrooms are prime sources of contamination simply because of their function. Because bodily fluids can transmit disease, toilets are obvious contamination points.

For example, a user typically needs to make contact with the flushing handle of the toilet. Toilets presently exist that automatically flush themselves once a user is finished, enabling the user to avoid contact with the handle.

However, individuals may also be exposed to contaminants when they lift or lower the seat of the toilet. Thus, there is a need for a hands free system that can lift and lower a toilet seat, without the need for the user to make physical contact with the toilet.

SUMMARY OF THE INVENTION

According to an exemplary embodiment of the invention, an apparatus configured to lift and lower a seat assembly of a toilet includes a case that is configured to be mounted to the toilet using existing mounting bolts of the seat assembly. The case includes a motion (e.g., a passive infrared (PIR)) sensor that outputs a detection signal in response to observed motion, a motor assembly comprising a motor driving unit and a motor, a first gear (e.g., a pinion gear) located on the shaft such that a rotation of the shaft of rotates the first gear, a second gear (e.g., a spur gear) located on an axle within the case and interfaced with the first gear such that a rotation of the first gear rotates the second gear, an output shaft connected to a clutch coupled to a lever exiting the case such that rotation of the output shaft lifts or lowers the lever, a wire rope wrapped around a hub of the second gear and a hub of the output shaft, and a micro-controller configured to send the direction signal to the motor driving unit indicating a direction of rotation based on the detection signal. The motor driving unit is configured to drive a shaft of the motor in a clockwise or a counterclockwise direction based on receipt of the direction signal.

BRIEF DESCRIPTION OF THE DRAWINGS

Exemplary embodiments of the invention can be understood in more detail from the following descriptions taken in conjunction with the accompanying drawings in which:

FIG. 25 illustrates a cross section through line B-B' of the lens of FIG. 23 according to an exemplary embodiment of the invention.

DETAILED DESCRIPTION OF THE EXEMPLARY EMBODIMENTS

Exemplary embodiments of the present invention will be described below in more detail with reference to the accompanying drawings. This invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
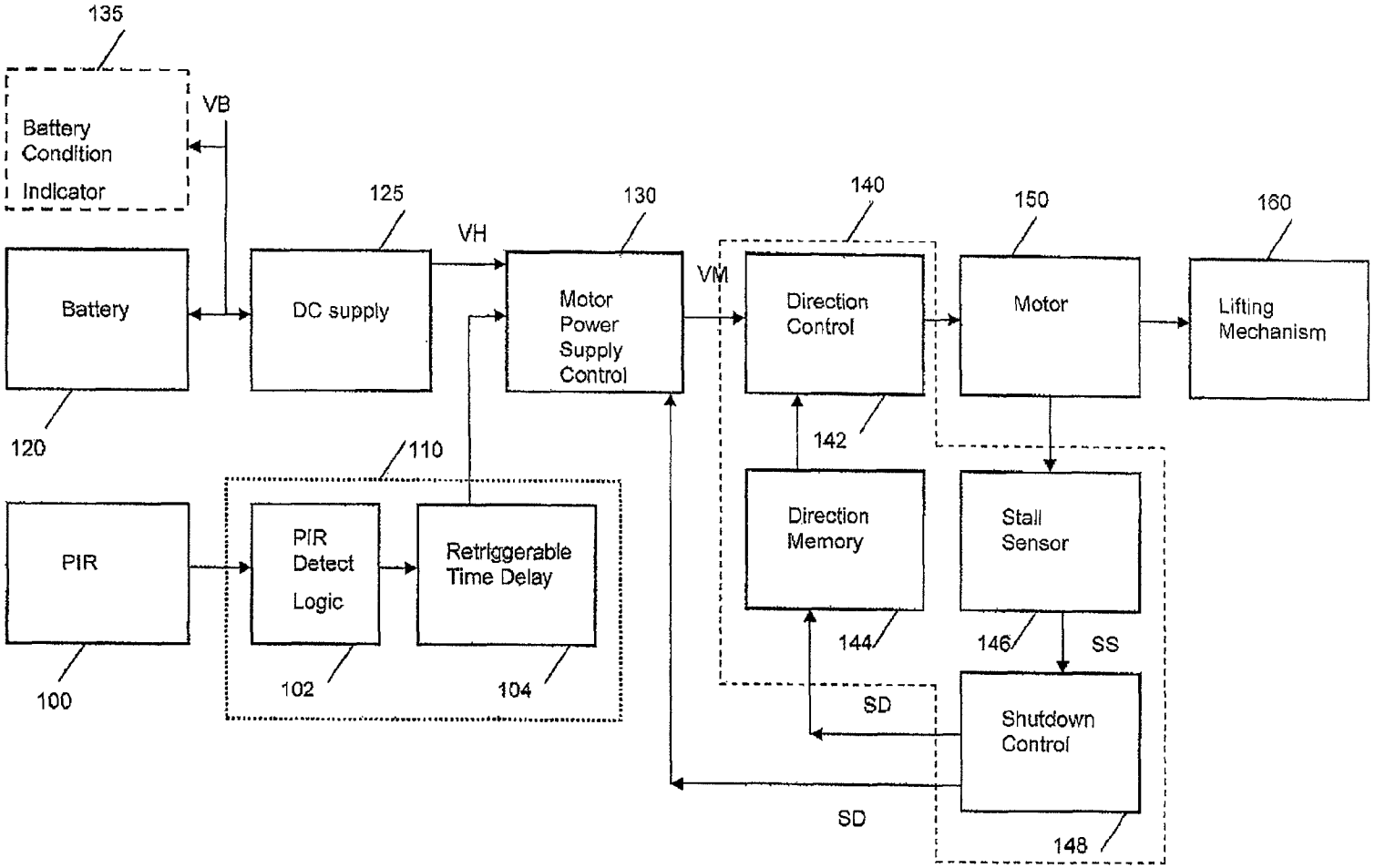
FIG. 1 illustrates a high-level block diagram of an apparatus to lift and lower a toilet seat in a hands free manner, according to an exemplary embodiment of the present invention.

FIG. 1 illustrates a high-level block diagram of an apparatus to lift and lower a toilet seat (and/or its lid) in a hands free manner, according to an exemplary embodiment of the present invention. The apparatus includes a Passive Infrared Sensor (PIR) 100, a Detection Controller Unit 110, a Motor Power Supply Unit 130, a Direction Controller Unit 140, a Motor 150, and a Battery 120.

The Detection Controller Unit 110 may include a PIR Detection Logic Module 102 and Re-Triggerable Time Delay Module 104. The Direction Controller Unit 140 may include a Direction Control Module 142, a Direction Memory Module 144, a Stall Sensor Module 146, and a Shutdown Control Module 148.

The apparatus is housed within a case. The case may be configured to fit between the bolts, the seat, and water tank of the toilet. In an embodiment of the present invention, the shaft of the Motor 150 exits the case and a lever of the lifting mechanism 160 is attached to the shaft via a coupler. The coupler may include a spring clutch. This embodiment will be discussed later in more detail with respect to FIGS. 3-5. In alternate embodiment of the present invention, instead of the lever being connected to the shaft of the Motor 150, a gear train is attached to increase torque of the Motor 150, and the lever of the lifting mechanism 160 is attached to a shaft of the gear train (e.g., via a coupler). This embodiment will be discussed later in more detail with respect to FIGS. 6-8.

Referring to FIG. 1, the apparatus may include a DC Power Supply 125 (e.g., about 12 v to about 16 v) and a Battery Condition Indicator 135. The Battery 120 supplies power to the DC Power Supply 125. The DC Power Supply 125 maintains a supply voltage $V_H$ to power the Motor Power Supply Unit 130. The Battery 120 may be rechargeable from a remote power source or may be non-rechargeable. The Battery Condition Indicator 135 is optional, and may cause an externally visible alarm light (e.g., an LED) to blink when a low charge is detected, or an internal buzzer to sound.

The case may be secured to a toilet such that a portion of the lever is positioned below a portion of the toilet seat assembly, at or near the axis of rotation of the assembly. Alternately, the case may be secured such that the lever is positioned under the toilet seat assembly to provide a new axis of rotation. The lever lifts or lowers the toilet seat and/or lid when the apparatus is activated by motion of a user (e.g., by motion of a hand near the PIR 100 of the apparatus).

The PIR 100 may be a pyro-electric device (e.g., sensor) that detects the motion by measuring changes in the infrared levels emitted by surrounding objects. The PIR 100 may have a predefined or configurable motion detection distance range (e.g., 0.5 meters) and detection angle (e.g., about 10 degrees to about 60 degrees). In an exemplary embodiment of the present invention, the detection distance is set to a defined area around the toilet. Alternately, ultrasonic or radio frequency means of detection may be used instead of infrared.

The PIR 100 may be disposed under an infrared filter window in a top cover of the case. The PIR 100 causes a change in its output voltage (e.g., a PIR signal) when it detects the arrival of infrared light, as when a hand is placed above the window. This output voltage may be sent to the PIR Detection Logic Unit 102, which analyzes the PIR signal to determine whether it meets certain criteria. For example, the criteria may specify a magnitude and length of a duration that would be associated with the presence and movement of a hand in the detection region above the window.

In the event that the PIR signal meets the criteria, the Re-Triggerable Time Delay Unit 104 (e.g., a re-triggerable OneShot) may be triggered to an 'on' state, and emit a control signal (e.g., a pulse with a positive leading edge) to turn on the Motor Power Supply Unit 130. The control signal may be set such that its minimum length assures that no other power-on command is issued during the 'on' time duration of the OneShot. However, if another acceptable PIR signal is detected during the normal 'on' time period of the OneShot, the time may be extended by a predetermined nominal 'on' time period of the OneShot. At the end of the period of time after the last trigger or re-trigger of the OneShot, the OneShot reverts to an 'off' state.

On receipt of the control signal (e.g., on receipt of the leading edge of the 'on' period of the OneShot), the Motor Power Supply Unit 130 is turned on. The Motor Power Supply Unit 130 supplies a voltage Vm to the Motor 150 via the Direction Control Module 142, which applies the voltage Vm to the motor coil of the Motor 150 to spin the shaft of the motor 150 in the clockwise rotation direction, or by reversing the side of the coil receiving voltage Vm, to spin the shaft in the counter-clockwise direction. The direction of rotation may be controlled by a Direction Memory Module 144 of the Direction Controller Unit 140, which commands either clockwise or counterclockwise rotation, which is reversed after completion of the last complete cycle of seat movement.

Since the lever is attached directly or indirectly to the shaft, and the lever is positioned under the seat assembly (e.g., the toilet seat), when the Motor Power Supply Unit 130 is turned on, rotation of the Motor 150 cause the seat to either lift or lower based on the direction that the shaft is rotated. The Direction Memory Module 144 stores the direction that the shaft is to be rotated to reverse the prior action and may store a default rotation direction initially. The Direction Control Module 142 uses this stored value to determine the direction that the shaft is to be rotated. Each subsequent triggering of the apparatus lifts or lowers the toilet seat in the opposite direction as it last travelled.

The lever is not permanently attached to the bottom of the toilet seat. As the lever lifts the seat, if the axes of rotation of the seat and lever are not properly aligned, the lever may slide along the bottom surface of the seat. A material that has a low coefficient of friction (e.g., Teflon) may be attached to the top surface of the lever to facilitate this sliding. When the lever is angled just short of a vertical position, due to gravity, the lever should remain in contact with the seat. However, if the lever extends beyond the vertical position, the seat may fall away from contact with the lever (e.g., the seat may fall away to contact the toilet tank). This can be prevented by creating a point of resistance for the lever. For example, a fixed or adjustable interference can be attached to the case in the path of the lever to obstruct the path of the lever before it reaches a vertical position.

Based on the design of the toilet, when lifting the seat, the seat could contact the toilet tank before moving beyond a vertical position, and thus the added interference may not be necessary. When the toilet seat is lowered, the seat or lever will eventually make contact with the toilet bowl. Further, the lever may experience a contact when a user uses his hands or foot to stop the seat while it is being lifted or lowered or pushes the seat in a direction opposite to which it is being currently moved by the Motor 150.

However, after one of the above described contacts has been made, the Motor 150 may attempt to continue spinning its shaft, which may strip the gears of the Motor 150. Thus, the Motor 150 may be turned off when or soon after these points of resistance are reached. Once the seat has reached either the 'up' or 'down' position, or encounters an artificial point of resistance, the physical interference with continued rotation will cause the current of the Motor 150 to increase towards its highest level, which may be referred to as Stall current.

The Stall Sensor Module 146 can continuously monitor the current of the Motor 150. When the level of the current exceeds a predefined normal operating current level (NOCL) or the NOCL plus a predefined current offset CO, the Stall Sensor Module 146 may output a stall signal SS to trigger the Shutdown Control Module 148 to send a shutdown SD signal to power down the Motor 150. In one embodiment, the NOCL plus the CO is set below the level of the Stall current.

The Shutdown Control Module 148 may send the shutdown signal SD immediately to the Direction Control Module 142 and the Motor Power Supply Unit 130 in response to the stall signal SS. The Direction Control Module 142 toggles the up/down state of the stored rotation direction in response to the shutdown signal SD. The Motor Power Supply 130 is powered down in response to the shutdown signal. For example, assume that the seat moving down and encountering the natural resistance of the toilet bowl triggered the shutdown. The Direction Memory Module 144 would then have stored a rotation direction of 'up' in response to the shutdown signal (e.g., The Direction Control Module 142 toggles 'down' to 'up'). When the PIR 100 is re-triggered due to motion, a new control signal would be generated by the Detection Controller Unit 110 to turn on the Motor Power Supply Unit 130, enabling the Motor Power Supply Unit 130 to again deliver the voltage Vm to the Direction Controller Unit 140. The Direction Control Module 140 would then apply the voltage Vm to the Motor 150 to spin its shaft according to the stored rotation direction (e.g., up), thereby causing the seat to lift upwards.

Alternately, the Shutdown Control Module 148 may be configured to output different shutdown signals of different time delays to the Direction Control Module 142 and the Motor Power Supply Unit 130 (e.g., a first shutdown signal and a second shutdown signal). For example, the Stall Sensor Module 146 may trigger a shutdown control operation of the Shutdown Control Module 148 by emitting a positive edge. The leading edge of the pulse may cause the Shutdown Control Module 148 to output the first shutdown signal to the Direction Control Module 142 having a first duration. At the expiration of the first duration, the Direction Control Module 142 toggles the state of the stored rotation direction. The leading edge of the pulse may cause the Shutdown Control Module 148 to delay for a predetermined period and upon expiration of the delay, output the second shutdown signal (e.g., a negative pulse) to the Motor Power Supply Unit 130, causing it to shutdown. In this way, the Direction Control Module 142 is able to toggle the storage state of the direction of rotation before the Motor Power Supply Unit 130 is powered down. If the Motor Power Supply Unit 130 is powered down without this delay, the Direction Memory Module 144 may not have enough time to update the state of the rotation direction. The shutdown operation includes the detection of the stall and the removal of power to the Motor 150. The shutdown operation is configured such that power is removed from the Motor 150 before the continued operation of the Motor 150 has enough time to damage its gears.

Each time the seat moves either from the 'down' position to the 'up' position or the 'up' position to the 'down' position is considered one complete cycle of the apparatus. At completion of one of these cycles, the apparatus is in an initial state of waiting for a PIR signal to start the next cycle of seat movement. At this time, the voltage Vm may be removed from the Motor Power Supply Unit 130 (e.g., Vm no longer supplied to Unit 130), thereby reducing the drain on the Battery 120. However, the DC Power Supply 125 can remain active to assure continued operation of the PIR 100. Battery power may be saved further by using a sleep mode to power down the circuits that remain active. For example, the DC Power Supply 125 could be disengaged from the battery 120 using a switch during the sleep mode and then re-engaged during a waking mode. For example, a third of every 100 ms of operation could correspond to the sleep mode and the other two thirds could correspond to the wake mode. This is merely an example, as the duty cycle of the apparatus may be changed as desired.

Figure 2:
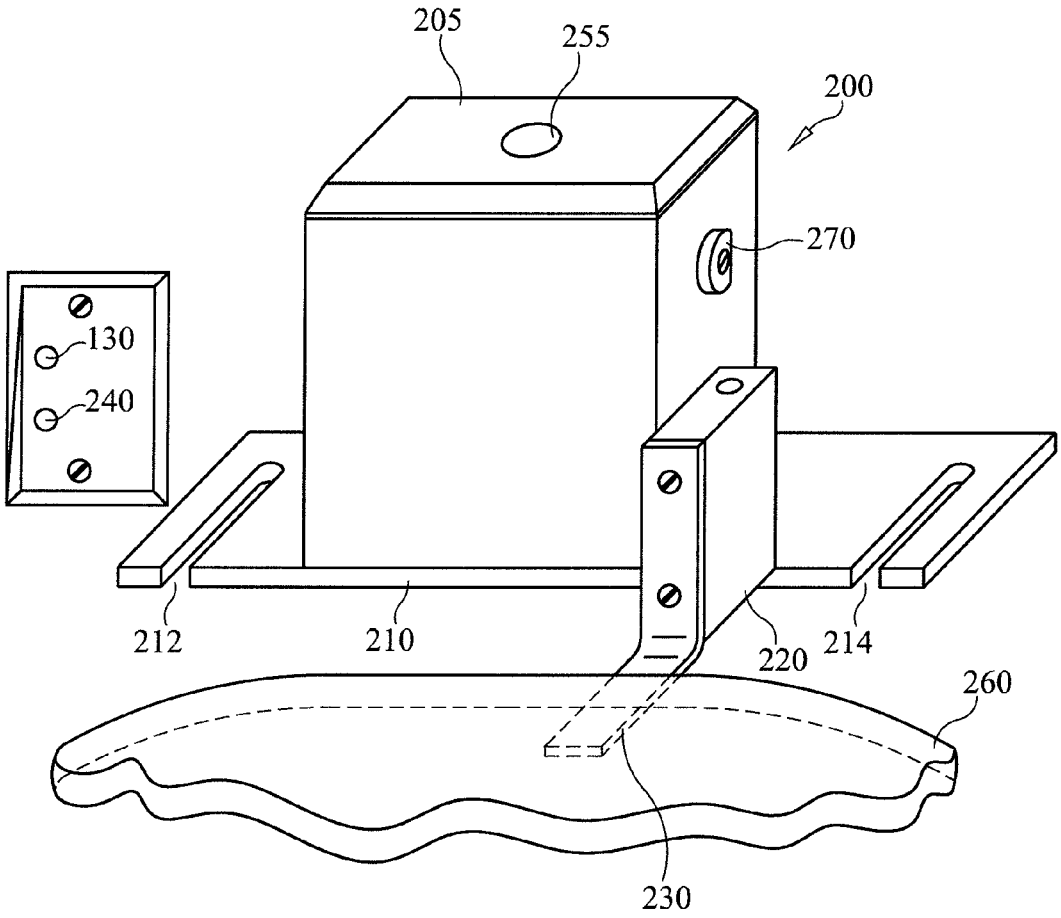
FIG. 2 illustrates an assembly view of the apparatus of FIG. 1, according to an exemplary embodiment of the present invention.

FIG. 2 illustrates an assembly view of the apparatus of FIG. 1, according to an exemplary embodiment of the present invention. The Case 200 of the apparatus includes a Base 210 and a Coupler 220 that attaches the Lever 230 to the shaft of the Motor 150. As discussed above, and shown in FIG. 2, the apparatus is positioned such that the Lever 230 is positioned below a Toilet Seat 260. The Lever 230 is coupled to the shaft (not shown) of the Motor 140 via the Coupler 220. In this example, the shaft exits the side of the case. However, in an alternate embodiment, the Lever 230 may be coupled to a shaft (not shown) or portion of a gear train that exits the front of the case.

A filter window 255 is located in a wall (e.g., the Cover 205) of the Case 200. The filter window 255 may be alternately located in one of the side walls or the front wall of the Case 200.

The Battery Condition Indicator 135 may be located in a wall (e.g., a side wall) of the Case 200. The Battery Indicator 130 may be alternately located in the front wall or omitted. The Case 200 may include a Recharge Port 240 in a side wall for recharging the Battery 120. Alternately, the Recharge Port 240 may be located in the Cover 205, the front wall, or the rear wall. The Recharge Port 240 may be omitted (e.g., when a non-rechargeable battery is used). Alternately, an internal audible buzzer may be included within the Case 200 that sounds to indicate the need to recharge or replace the Battery 120.

An adjustable interference 270 may be attached on the same side of the Case 200 as the Coupler 220. The interference 270 is positioned such that it rests in the path of the Coupler 220 or the Lever 230 to interfere with the rotation of the Coupler 220 or the Lever 230. If the interference is positioned properly, as the Coupler 220 rotates, it will eventually contact the interference 270, and the Motor 150 turns off shortly thereafter. The interference 270 may have an asymmetric shape and be rotated to adjust the upper limit for the Lever 230. Alternately, a fixed interference may be used to fix the upper limit of the Lever 230.

The Case 200 may be attached to the Base 210 in various ways, such as welding, nails, screws, glue, solder, etc. The Base 210 may be configured to lie on the plane of the toilet. A seat assembly of the toilet (e.g., the Toilet Seat 260 and a Toilet Seat Lid) is typically mounted to a toilet bowl by means of two mounting bolts. The Base 210 is configured to mount under the seat assembly mounts and lie on the surface (e.g., ceramic) of the toilet bowl. The Base 210 is held in place by the same mounting bolts that are used to connect the seat assembly to the toilet bowl. For example, the Base 210 may include a left slot 212 and a right slot 214 that are spaced to correspond to spacing of the seat mounting bolts and dimensioned to receive the bolts. The slots 212 and 214 provide for installation of the apparatus without the need to fully remove the seat and lid mounts, and also for adjusting a relative distance between the front of the Base 210 and the rear of the Toilet Seat 260. In an alternate embodiment of the present invention, the slots 212 and 214 are replaced with corresponding holes (e.g., circular, oblong, etc.) to receive the mounting bolts. The slots 212 and 214 permit the Lever 230 to be moved nearer to or further from the Seat 260, permitting the rotation axis of the Lever 230 to conform more closely to the axis of rotation of the Seat 260.

As discussed above, the Motor 150 is internal to the Case 200 and either the shaft or a portion of a gear train (e.g., a rod) exits from a side or front of the Case 200. The Coupler 220 is installed on the shaft or rod. For example, the shaft may have a flat, which is engaged within the Coupler 220 by a spring and washer, which is forced by the spring onto the flat. The force of the spring may be controlled by advancing a bolt, entering the Coupler 220 from the top, and constraining the coupler to rotate as the shaft rotates. This spring assembly forms a clutch which permits the washer to be forced off the flat, if excessive force is applied by manual lifting or lowering of the seat 260, which force is transmitted to the coupler 220 via the Lever 230. This prevents such movement of the Seat 260 from applying external force to the gears of the Motor 150, which could cause damage to those gears. Thus the shaft is decoupled from the Coupler 220, and will be re-coupled when rotation of the shaft once again brings the washer in line with the flat, which permits the spring to force the washer up against the flat once more.

If, when the motor is not running under power, and the shaft is not decoupled from the Coupler 220, application of an excessive force to the shaft could damage the Motor 150 or its gears. When the motor is not running, the Stall Sensor Module 146 cannot sense when this excessive force is occurring by detecting an impending Stall Current and triggering the powering down of the Motor 150. Accordingly, when such force occurs, the clutch protects the Motor 150 by decoupling the Lever 230 and Coupler 220 from the Motor 150 or its Gear Train.

If the Seat 260 ever becomes hung in mid position after power to the Motor 150 is turned off, upon retriggering the PIR 100, the Seat 260 will either go up or down based the current state of the saved rotation direction (e.g., which may be stored in direction memory 144).

The Coupler 220 drives the Lever 230, which is positioned so that, with the Toilet Seat 260 down, the Lever 230 contacts the bottom side of the Seat 260. Then, when the Coupler 220 rotates in, for example, the clockwise direction, the Lever 230 exerts a lifting force on the bottom of the Seat 260, causing it to lift. When the Seat 260 is up, an alternate rotation of the shaft (e.g., in a counter-clockwise direction) causes the Lever 230 to disengage from the bottom side of the Seat 260.

If the position of the Seat 260 is less than vertical, gravity causes the Seat 260 to fall against the Lever 230 and follow it down. If the Seat 260 has been lifted past vertical (e.g., assume the interference 270 is not present or is improperly positioned), in an alternate embodiment of the present invention, a second part of the Lever 230 can be attached to the Coupler 220 to contact the top surface of the Seat 260, to exert a force to lower the Seat 260 when the shaft is rotated to lower the Seat 260 (e.g., in a counter-clockwise direction). Alternately, the Lever 230 can provide a flexible lanyard (e.g., a rope), attached to the bottom of the Seat 260 by tape or some other temporary attachment mechanism. When the shaft rotates in the 'down' direction, the lanyard can pull the Seat 260 to just below vertical, and then the Seat 260 will continue to follow the Lever 230 downward with the force of gravity.

In an alternate embodiment of the present invention, sensors may be attached to the Case 200 to detect the position of the Coupler 220. For example, the sensors would detect whether the Coupler 220 is about exceed vertical and could trigger a mechanism to restrain the Coupler 220 from going any further. The sensing means may include light or laser sensors, magnetic sensors, electrical contact sensors, etc.

The relationship between the current the Motor 150 draws from the Motor Power Supply Unit 130 and the speed and torque of the motor may be used to determine whether there is a need to stop the motor, or change the direction of rotation. For example, if the current drawn by the Motor 150 when starting from a standing position, either 'up' or 'down', is unique in magnitude and transient time behavior (e.g., the magnitude or transient behavior during a stall condition), this behavior can be used to permit the motor to continue in its initial direction, or change direction and continue until the Seat 260 reaches its final condition, either up or down, as evidenced by the detection of the Stall condition. The startup current, if the Motor 150 is being driven in the 'up' direction, with the Seat 260 down, will be larger than for other conditions or initial seat positions, and thus will be distinguishable in either magnitude or transient time behavior from a true Stall condition. If the current drawn by the Motor 150, when reaching a Stall condition is unique in magnitude and transient time behavior, its analysis can be used to cause the Motor 150 to either reverse or stop. The time interval between a last PIR activation and the event itself may be used to determine whether stopping or reversing the Motor 150 is the proper course of action. Further, a time delay may be used to delay examination of the motor current to prevent the startup current from falsely triggering the Stall Condition.

Since the apparatus is typically installed within a bathroom, where the availability of water makes the presence of high voltage AC power contraindicated, the Battery 120 (e.g., a 9 v) can be recharged from a portable battery supply (e.g., 12 v), which itself has been kept on recharge. Many such batteries for multiple such apparatuses can be recharged from a single portable battery supply. The Battery 120 may be charged through the Recharge Port 240. For example, the Battery Indicator 130 may blink a color (e.g., red) using a light (e.g., an LED) to indicate the need for recharge.

Figure 3:
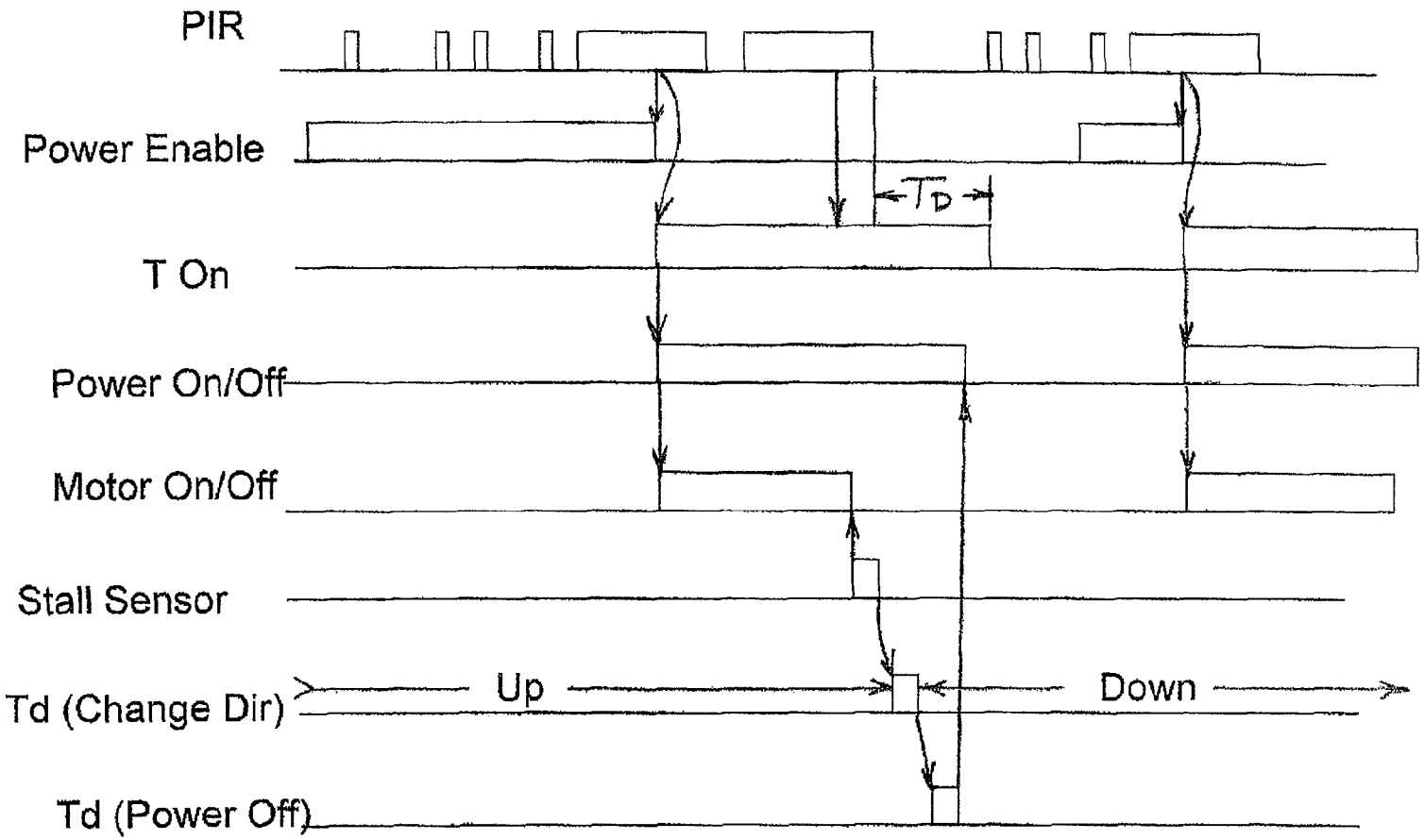
FIG. 3 illustrates timing of signals of the apparatus of FIG. 1, according to an exemplary embodiment of the present invention.

FIG. 3 illustrates timing of signals of the apparatus of FIG. 1, according to an exemplary embodiment of the present invention. During certain conditions, the PIR 100 may emit a pulse PIR that is too short to meet the criteria for registration. The criteria may be a pre-selected time duration $T_{MIN}$ that is chosen to avoid false detection in the environment of installation. When the length of the emitted pulse PIR reaches the pre-selected time duration $T_{MIN}$, the PIR 100 triggers a signal $T_{ON}$, which remains 'on' (e.g., transitions from a logic low to a logic high) for a time period that is longer than time duration $T_{MIN}$. If signal $T_{ON}$ is already 'on' and an acceptable new pulse PIR is recognized, the remaining 'on' time of signal $T_{ON}$ can be extended by the pre-selected time $T_{MIN}$. This renewal can occur as many times as such a pulse PIR is received while signal $T_{ON}$ is on.

The leading edge of signal $T_{ON}$ may be differentiated and used to turn on the Motor Supply Unit 130 to generate a power control signal PowerOn. The power control signal PowerOn is then used to turn on the Motor 150, which outputs a signal MotorON. The motor power may be latched to the 'on' state, and can then be turned off when one of a Stall event or an End event occurs first. The Stall event is the detection of the Stall condition by the Stall Sensor Module 146, which generates a stall signal StallSensor. The end event may be the negative edge of signal Ton, when signal Ton signal transitions from a logic high to a logic low. The length of signal $T_{ON}$ may be configured to be long enough to ensure that the first event occurs first. The stall event starts a signal $T_D$(X Dir) and reverses the control of motor direction sometime during the length of the stall signal StallSensor. This reversal opposes the Stall Sensor condition.

The Stall Event starts a time delay signal $T_D$(PowerOff), which is longer than signal $T_D$(X Dir) to assure that the motor direction control (direction controller 140) has completed is change of direction. At the end of signal $T_D$(PowerOff), a latch of the Motor Power Supply 130 is released, and the Motor 150 stops, leaving the Seat 260 in its last position. If the End Event occurs first (e.g., signal $T_{ON}$ ends before the Stall Event occurs), the negative differentiated edge of signal $T_{ON}$ can be used to unlatch the Motor Power Supply 130, thereby stopping the Motor 150.

Figure 4:
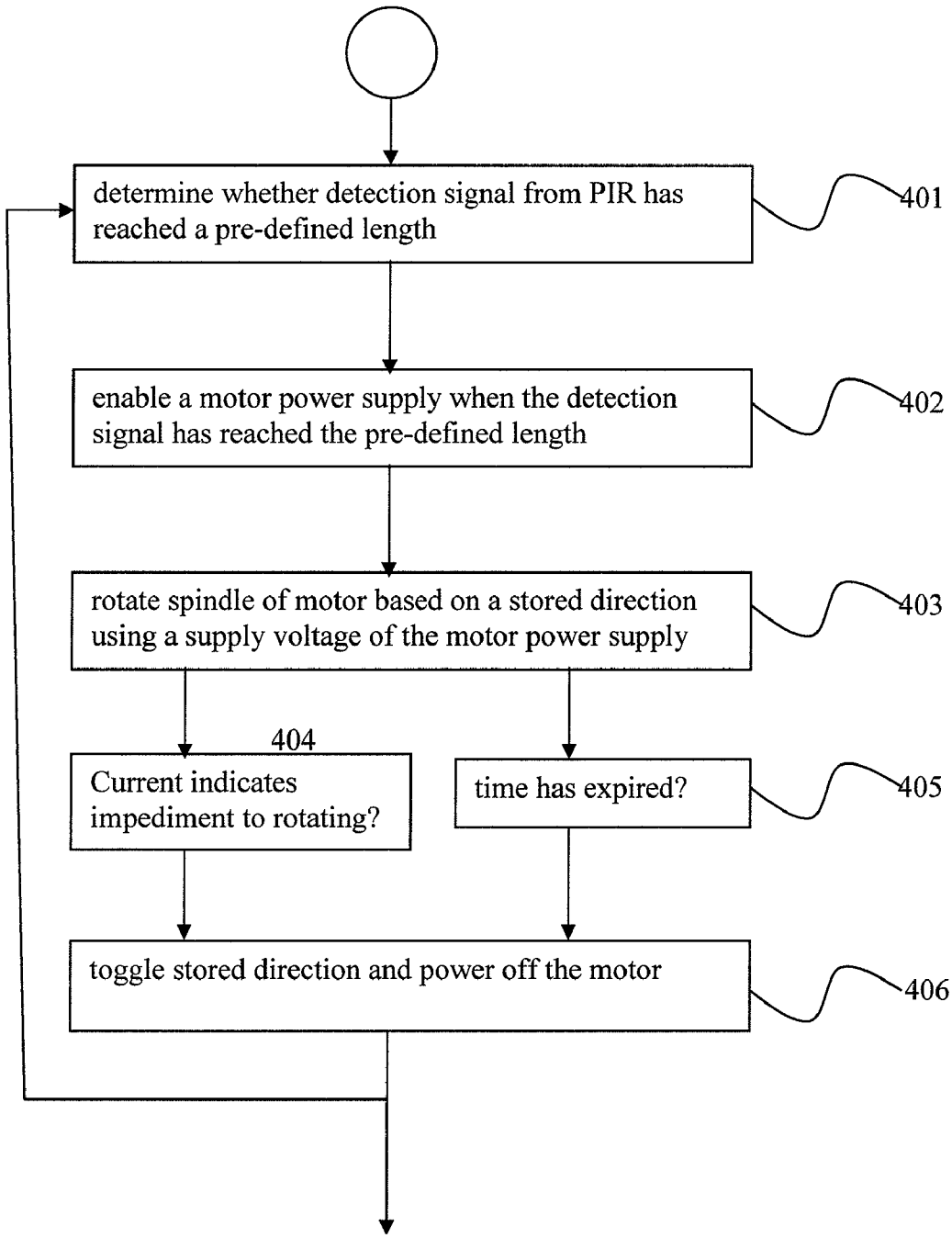
FIG. 4 illustrates a high level flow chart of a method of driving the apparatus of FIG. 1, according to an exemplary embodiment of the present invention.

FIG. 4 illustrates a high level flow chart of a method of driving the apparatus of FIG. 1, according to an exemplary embodiment of the present invention. Referring to FIG. 4, the method includes determining whether a detection signal emitted from a passive infrared sensor (PIR) has reached a pre-defined duration (S401), enabling a motor power supply when the detection signal has reached the pre-defined duration (S402), rotating a shaft of a motor in a direction (e.g., clockwise or counterclockwise) based on a stored direction using a supply voltage of the motor power supply (S403), determining whether current of the motor indicates an impediment to the rotating (S404) and/or determining whether a time period has expired (S405), and then based on either of these events, toggling the stored direction and powering off the motor (S406). Since the Lever 230 is attached to the shaft of the motor (or to a shaft attached to a gear train attached to the shaft) and positioned under the Toilet Seat 260, when the rotating has completed, the Seat 260 has either travelled up or down. The Seat 260 can then be moved in an opposite direction by repeating the above described method.

In an alternate embodiment of the present invention, a second PIR is included in the apparatus. The first PIR (e.g., PIR 100) and the second PIR (not shown) are used together to determine whether a user desires for the Seat 260 to move up or down. The 2 PIRs may be positioned to determine whether a hand has made a rightward motion or a leftward motion. For example, the first PIR could be positioned to the left of the second PIR, and triggering the first PIR with motion followed by triggering the second PIR within a certain time period may trigger the apparatus to move the Seat 260 downward. For example, the Detection Controller Unit 110 may be modified to receive outputs of both PIRs and determine whether the outputs suggest that an upward or downward motion of the Seat 260 is desired. Vice versa, triggering the second PIR with motion followed by the first PIR could trigger the apparatus to move the Seat 260 upwards. The 2 PIRs may alternately be positioned above and below one another, and then detection of motion from up to down could trigger the apparatus to move the Seat 260 downwards and detection of motion from down to up could trigger the apparatus to move the Seat 260 upwards. When two PIRs are used as described, the Direction Control Module 142 and the Direction Memory Module 144 may be omitted. For example, sensing of the stall current need not be used to determine the direction that the shaft is rotated. The Detection Controller Unit 110 can then be modified to apply the voltage Vm to the Motor coil of the Motor 150 to spin the shaft of the Motor 150 in the clockwise rotation direction, or by reversing the side of the coil receiving Vm, to spin the shaft in the counter-clockwise direction based on both outputs of the 2 PIRs.

Since a device according at least one embodiment of the above described invention is mounted to the toilet using the mounting bolts of the existing seat assembly having a standard separation distance, the device is considered a universally installable device. The device can be readily installed on the large population of already installed toilets, without physical alteration of either the seat assembly or the toilet itself. The device may be offered to OEM accounts to be provided as an add-on option to their current toilet seat designs without requiring modification of their standard production.

Figure 5:
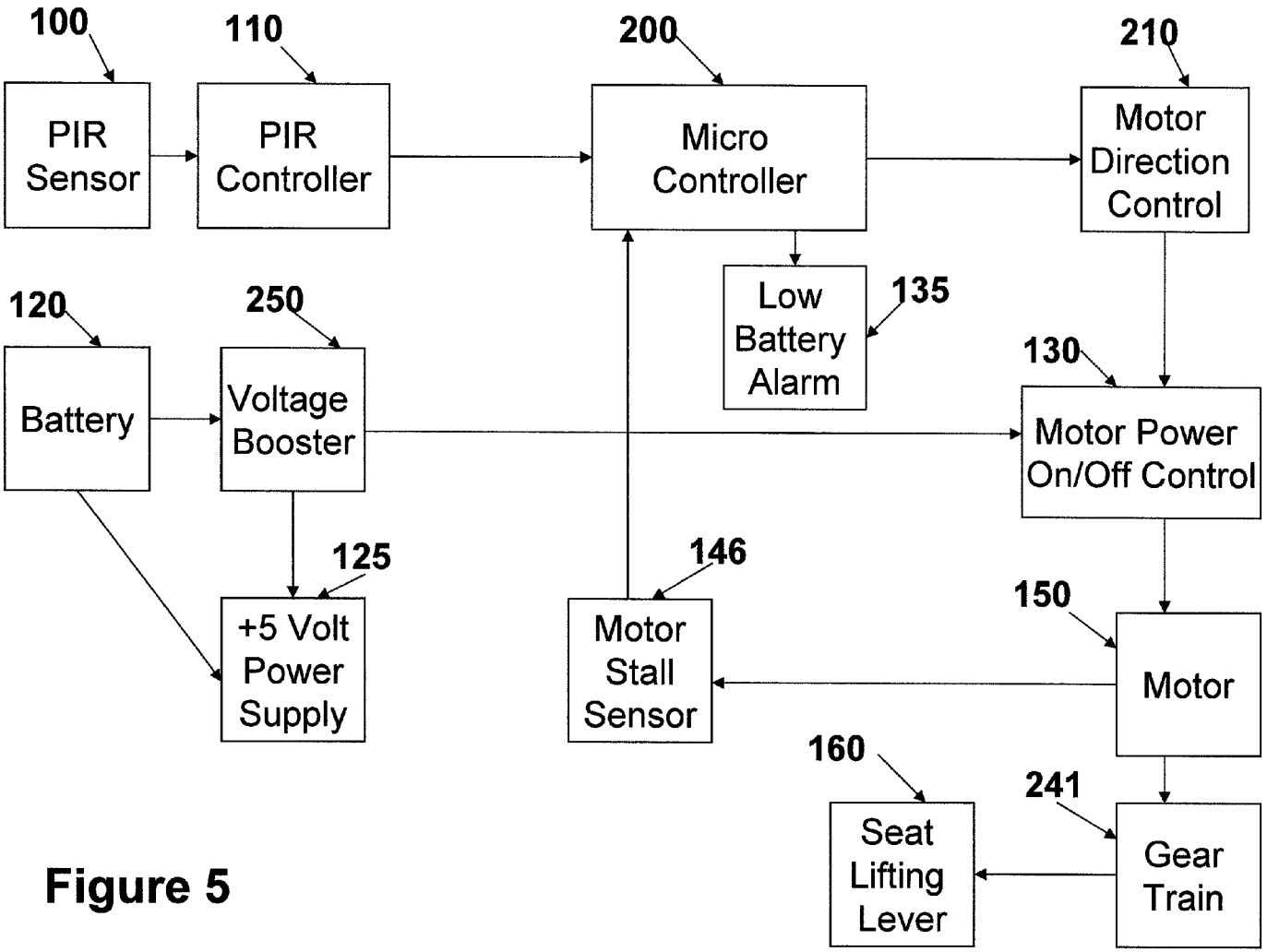
FIG. 5 illustrates a high-level block diagram of an apparatus to lift and lower a toilet seat in a hands free manner, according to another exemplary embodiment of the present invention.

FIG. 5 illustrates a high-level block diagram of an apparatus to lift and lower a toilet seat in a hands free manner, according to another exemplary embodiment of the present invention. Similar to the block diagram of FIG. 1, the PIR Sensor 100 is monitored by the Detection Controller Unit 110, and when a satisfactory signal is observed, (e.g., 200 msec of continuous Infrared sensing), it instructs a Micro-Controller (Micro) 200 to lift or lower the Seat 260, depending on its memory of the last position of the Seat 260. The Micro 200 carries out this instruction using a Motor Direction Control relay 210. The Micro 200 then instructs the Motor Power Supply 130 to turn 'On', and the Motor 150 starts to turn in the proper direction as required.

The Stall Sensor Module 146 monitors current of the Motor 150, and when the current increases to a value deemed by past experience to represent a Stall Condition, (e.g., when the Seat 260 has encountered an obstruction caused by reaching either the top or the bottom of its travel) the Module 146 sends a signal to the Micro 200 to indicate the condition is present, so that the Micro 200 can shut down power to the Motor 150, thus ending the operation. For example, the signal may indicate the current value of the motor current. Stopping the Seat 260 in mid travel by use of a hand will also cause the Micro 200 to end motor power, thus preventing the gears of the Motor 150 from stripping.

Different from the block diagram of FIG. 1, the Motor 150 drives the lifting mechanism 160 through a Gear Train 241. The Gear Train 241 is normally engaged. But, if it is desired to replace the need for a clutch between the Lever 230 and the Motor 150, to protect against application of an external force on the toilet seat, which would damage the Motor 150, a disengagement mechanism may be used to disengage the Gear Train 240 between the Lever 230 and the Motor 150. When the Micro 200 wants the Motor 150 to start, it energizes a Solenoid 235, which engages the gears so that the Motor 150 can drive the lifting mechanism 160. When the Motor 150 is told to stop, the Micro 200 de-energizes the Solenoid 235, disengaging the gears. This allows the Seat 260 to be lifted or lowered manually (e.g., by a hand), if desired, so long as the PIR Sensor 100 is not activated. This eliminates the need for a clutch, which was discussed above with respect to FIG. 1 to prevent stripping of the gears if someone inadvertently lifted the seat by hand.

In an exemplary embodiment of the present invention, the battery 120 has a 6 volt output when fully charged. Over time and use of the apparatus, the battery 120 will gradually lose its charge. For example, the charge could eventually fall to 3.2 volts. The apparatus may optionally include a Voltage Booster 250, which can maintain a constant voltage (e.g., about 12 v to about 16 volt) to the Motor 150, regardless of the voltage of the Battery 120. The output of the Voltage Booster 250 is fed to the DC supply 125 (e.g., +5 volt) supply, which is used to operate the rest of the elements of the apparatus, even when the voltage of the Battery 120 falls below a threshold level (e.g., about 3.2 volts). Since all voltages are monitored by the Micro 200, the Micro 200 is able to control the operation of the Voltage Booster 250 to maintain all needed voltages in their required range, until the Battery 120 is essentially completely drained. Before the battery 120 dies, the Micro 200 can use the Battery Condition Indicator 135 to send out a signal to alert a user to change the Battery 120. In this way, a supply voltage (e.g., about 5 volts) to the computer chips may be maintained, even if the booster voltage drops to the threshold level (e.g., about 3.2 volts).

Figure 6:
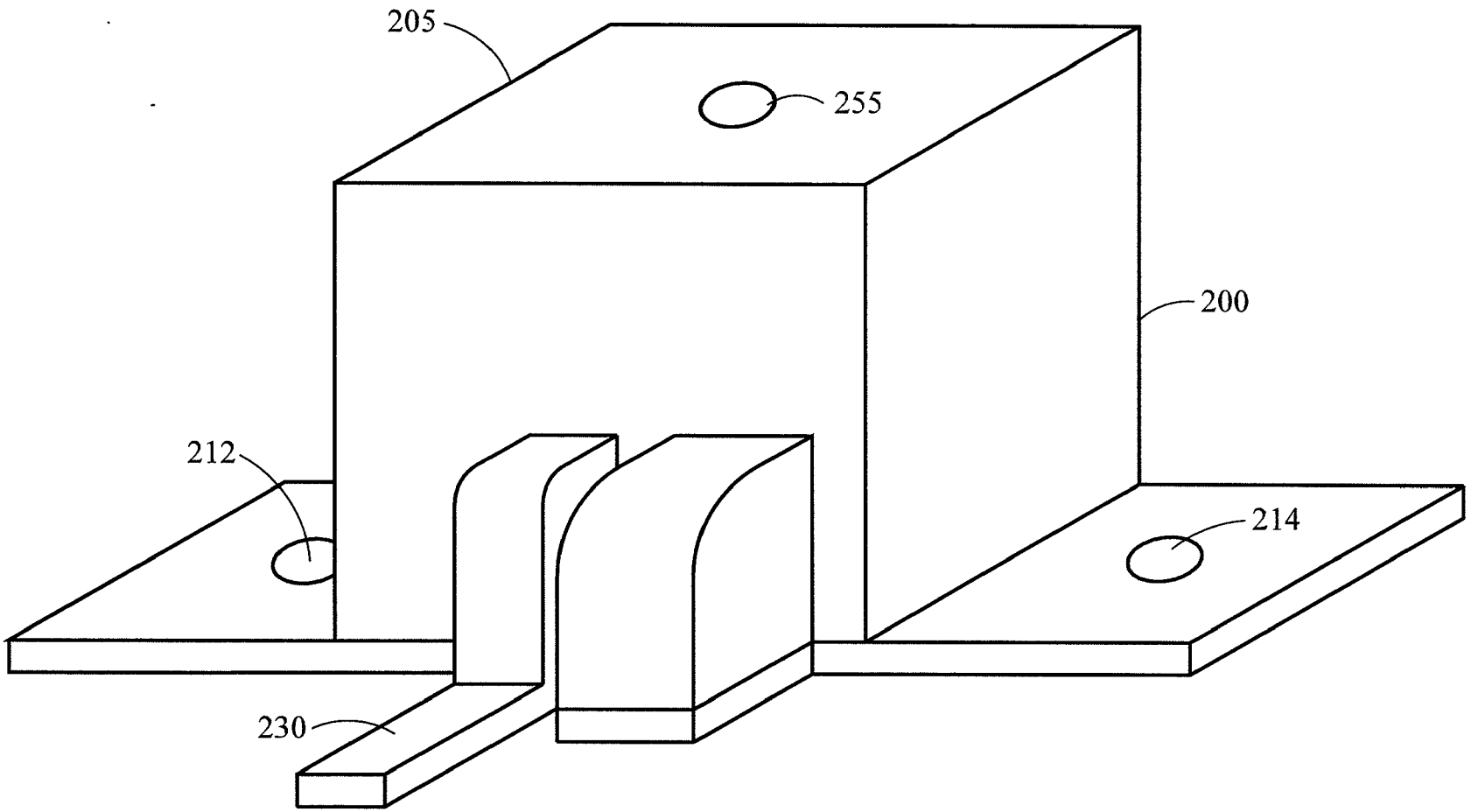
FIG. 6 illustrates an assembly view of the apparatus of FIG. 5, according to another exemplary embodiment of the present invention.

FIG. 6 illustrates an assembly view of the apparatus of FIG. 5, according to another exemplary embodiment of the present invention. In this embodiment, the lever 230 is positioned in front of the case, and is driven by the Gear Train 241 connecting the Motor 150 to a shaft of the Lever 230.

Figure 7:
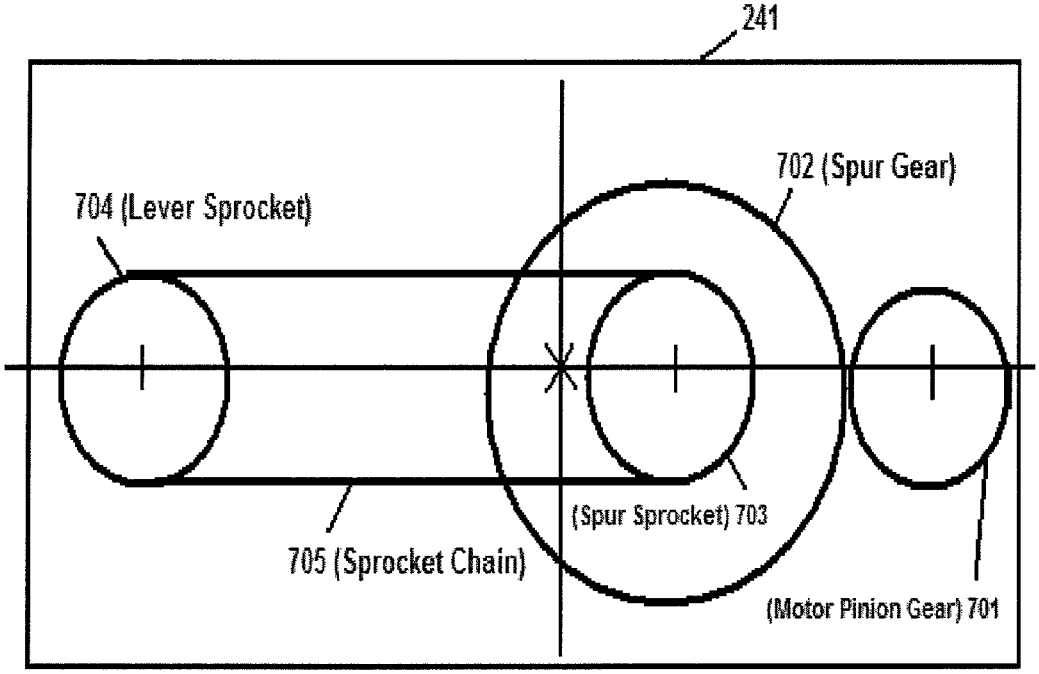
FIG. 7 illustrates a gear train of FIG. 6, according to an exemplary embodiment of the present invention.

FIG. 7 illustrates elements of a gear train 241 of FIG. 5 being attached to a Motor 150, according to an exemplary embodiment of the present invention. Referring to FIG. 7, a pinion gear 701 is attached to the shaft of the Motor 150. The shaft may be supported by a first rod (not shown) in the case. When a second gear (e.g., a spur gear) 702 is engaged into the pinion gear 701, the second gear 702 turns in the opposite direction as the pinion gear 701. In an exemplary embodiment of the present invention, the second gear 702 has a diameter that is about 3 times larger than the pinion gear 701. A first axle (not shown) may be fitted through the center of the second gear 702, which enables the gear to rotate. The first axle may be supported by a second rod (not shown) in the case. The first axle drives (rotates) a pair of sprockets 703 and 704 having a corresponding chain 705. The sprockets 703 and 704 drive (rotates) a shaft attached to the Lever 230. The arrangement shown in FIG. 7 may lift the Lever 230 at the same speed as the apparatus of FIG. 1, but with more torque, as a larger motor may be utilized.

According to an exemplary embodiment of the present invention, the pinion gear 701 may be pulled apart (e.g., disengaged) from the second gear 702 using a spring (not shown) and pushed together (e.g., engaged) using a solenoid (not shown). Since this pushing and pulling requires an axle of the first or second gear 701 or 702 to be able to move laterally, one of the corresponding supporting rods may include a slot that allows an axle of one of the gears 701 or 702 to be moved from side to side. The width of the slot is configured to be wide enough to allow the gears 701 and 702 to be separated from one another.

Figure 8A:
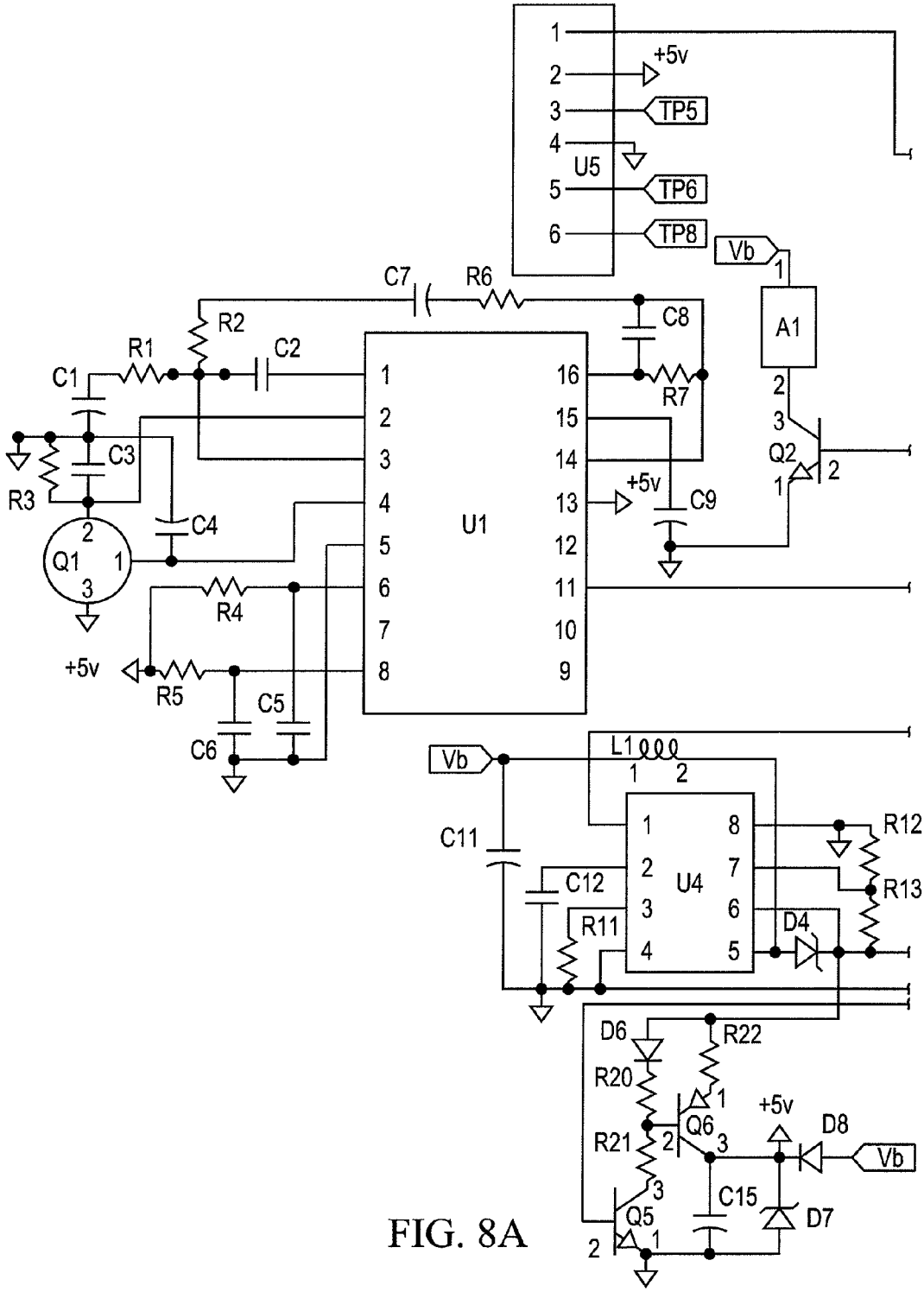
FIG. 8A and FIG. 8B illustrates a detailed schematic of the apparatus of FIG. 5, according to an exemplary embodiment of the present invention.
Figure 8B:
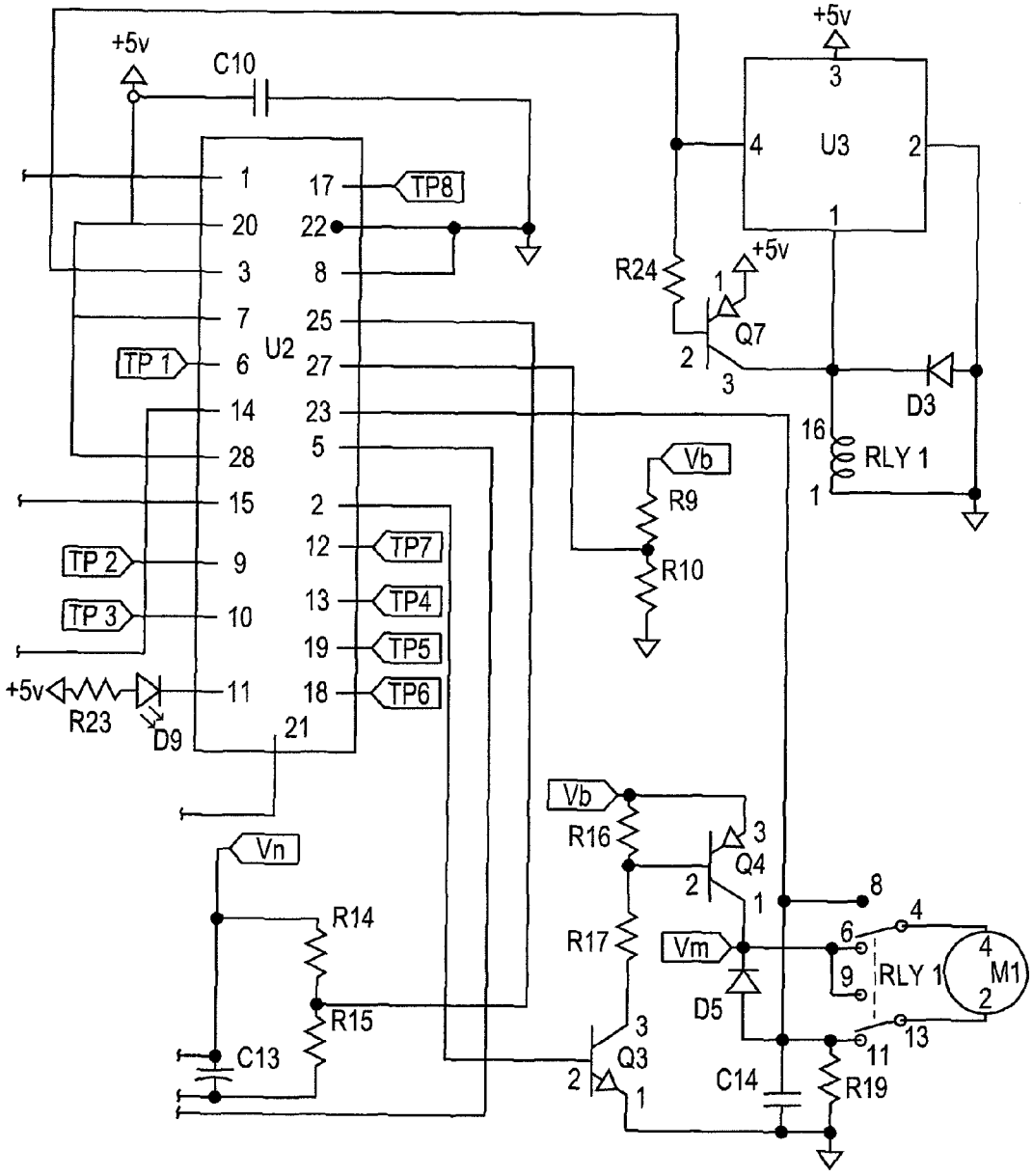

FIG. 8A and FIG. 8B illustrates a detailed schematic of the apparatus of FIG. 5, according to an exemplary embodiment of the present invention. Referring to FIG. 8A and FIG. 8B, the PIR Sensor Q1 and the PIR Controller U1 operate in a similar manner to those previously described, except that the positive output gate of PIR Controller I1 is delivered directly to Micro Controller I3. The Micro Controller U2 is a programmable computer chip, which may be equipped with I/O, RAM, ROM, ND Converters.

The Micro Controller U2 is programmed to react to the positive gate to perform the functions described below. For example, the Micro Controller U2 recalls the memorized direction that the Motor M1 (e.g., Motor 150 of FIG. 5) should rotate, which will be opposite to the last time the motor was turned on. The rotation is executed by the Micro Controller U2 either turning on or off a Power Switch U3 or Q7, which determines the state of the contacts of the Double Pole Double Throw relay X1 (or a solid state equivalent). Power On causes the Motor M1 to rotate in the Lift direction, and Power Off causes a Lowering direction of rotation, when Motor voltage Vm is applied.

After turning the Power Switch U3 On or Off, the Micro Controller U2, causes transistor Q3 to turn transistor Q4 On. This delivers voltage Vm to Relay RLY 1. Depending on the energized or de-energized condition of the relay coil, the positive voltage Vm, will be applied to one or the other side of the Motor M1, corresponding to the Clockwise or Counter Clockwise rotation of the corresponding shaft.

Current of the Motor M1, whether rotating in either direction, is delivered to Ground via resistor R19. The voltage across R19 is therefore directly proportional to the current of the Motor M1. This current is a function of motor speed and torque. So, when the Motor M1 is stalled due to an obstruction, the current increases to a limit which may be termed the Stall Current. The Resistor R19 is bypassed by Capacitor C13 to insure that transients will not falsely cause a voltage spike that could be interpreted as a breaching of the Stall Current.

The voltage across Resistor R19 is delivered to the Micro Controller U2, which uses its ND conversion function to create a digital number proportional to the current of the Motor M1. The Micro Controller U2 compares this number to an internally stored digital number N1, representing an amount of Motor current above which it can be declared that the Motor M1 is about to Stall. This Stall condition should not be permitted as it might damage the gears of the Motor M1. But, in any event, the condition means that the Seat 260 has reached the end of its travel and is being restricted from further lifting or lowering by a physical obstruction. For example the obstruction could be either the Toilet itself, if going Down, or the Water Tank, or other obstruction, if going Up. So, on breaching this predetermined Stall threshold, the Micro Controller U2 shuts off transistor Q4, terminating the On state of transistor Q3 and terminating the rotation of the shaft.

In an exemplary embodiment of the present invention, the battery 120 is a 6 volt battery and supplies power to each element of the apparatus. This may avoid the need to create a separate power supply to operate the individual elements, which may operate in one embodiment between 4.5 and 5.5 volts, and up to a 7 volts maximum. Thus all elements of the apparatus can be operated directly from the Battery 120 via a Diode D5, which can be used to reduce the voltage from 6 volts to 5.4 volts. When the battery 120 is 6 volts, it may comprise four 1.5 volt cells (e.g., AA, C, etc).

In an exemplary embodiment of the present invention, the Motor M1 (or 150) is provided as a 12 volt device. In an exemplary embodiment where the Motor 150 is 12 volts and the battery is 6 volts, 12 volts is created from the 6 volts to operate the Motor 150. This may be accomplished by embodying the Voltage Booster 250 as a Voltage Doubler. Alternatively a Voltage Booster 250 can be used, which not only produces an output voltage greater than 6 volts, but maintains this high voltage essentially independent of the gradually declining battery voltage, as its capacity is used up.

The Voltage Booster 250 may be represented by element U4, whose output voltage $V_H$ can be, in one embodiment, as high as 16 volts. Use of element U4 may be used to keep the Motor power essentially constant, up to the point where the battery 120 is essentially fully drained. When the battery 120 is 6 volts and four 1.5 volt batteries are used, this point may be reached when each 1.5 volt battery cell is reduced to 0.8 volts.

However, before all the power in the battery 120 is used up, the original 6 volt total would have long since been reduced to 3.2 volts, well below the operating level of some or all of the elements of the apparatus. Accordingly, in an exemplary embodiment of the present invention, the Micro Controller U2, having access to the chip supply voltage (see V+ in FIG. 8, e.g., about +5 v), and observing its level falling below a threshold level periodically turns on the Voltage Doubler or Booster 250, even when not called upon to run the Motor 150. For example, if the Micro 200 determines that the battery voltage has fallen below a threshold voltage (e.g., to 4.8 volts or below), the Micro can control transistor Q5 to recharge C15 up to a higher level (e.g., 5.5 volts) to restore the charge on C15 to a previous level (e.g., to at least 4.5 volts), so long as voltage Vb is high enough to keep voltage $V_H$ above a desired voltage (e.g., about 10 volts), below which the system will be shutdown anyway by the Micro This process can repeat as often as necessary to maintain the voltage levels between an operable range (e.g., between about 4.5 volts and about 5.5 volts). This may insure continued operation of the PIR Controller 100 and the other elements, even when the voltage of the battery 120 falls to a low level (e.g., 3.2 volts).

In an exemplary embodiment of the present invention, an alarm is used to alert a user that the battery 120 needs to be replaced. The Micro Controller U2 can be configured to sense depletion of voltage of the battery 120 to some still viable level (e.g., 3.3 volts) and then enable transistor Q2 to activate a Piezoelectric Buzzer A1, whose audio can be heard outside the case of the apparatus.

The alarm can be used for other purposes, such as when the Micro Controller U2 (or 200) senses a condition that might affect performance. An example would be the development of very high friction in the lifting mechanism itself, which would cause an increase in the average Motor current required. This can be done by storing/memorizing the value of the Motor current when first installed, and comparing the most recent values after much usage has occurred.

As discussed above, the value N1 represents an amount of Motor current above which it can be inferred that the Motor M1 is about to stall. This value N1 can be derived by actual experience in each installation, in which the toilet Seat weight or friction can vary from a norm, and in which Battery depletion, if not remedied by the function described above, can be a factor in determining Stall current behavior. Accordingly, in an exemplary embodiment of the present invention, the Micro Controller U2 is configured to examine the actual measured Stall Current and derive a dynamic Stall Current Reference from the observed behavior.

Further, as discussed above, when Motor power is first turned on, the Motor M1 may require more current initially (e.g., a startup current) before reaching steady state operation. If the startup current too large, it may trigger the Stall Detection routine and stop Motor M1 rotation effectively before it even starts. Accordingly, in an exemplary embodiment of the present invention, the behavior of the Motor current is analyzed by the Micro Controller U2 to determine how long it takes for the Motor current to decline from the high Startup value to a normal Steady State value. The Micro Controller U2 then activates a Stall Sensor Time Delay, which for that amount of time after startup, may be used to prevent a false Stall Current value from prematurely shutting down operation of the Motor M1.

Referring back to FIGS. 5 and 6, the Motor 150 may be mounted parallel to the axis of the Seat 260 to the side of a case from which the shaft or rod exits (e.g., by two machine screws). A Battery Mount may be secured to the interior of the case above the Motor 150 by either screws, stand-offs or by welding. Access to the Battery mount may be gained by an opening on the side opposite to the Coupler 220, which may be covered by a gasket and a cover Plate, which are attached (e.g., bolted) to the Battery Mount, which simultaneously secures the Batteries into the Mount, while permitting sufficient force holding the Plate against the exterior side of the Case 200 to compress the gasket. This may insure that the entire assembly is sealed against entry of water. The exit point of the shaft or rod may be "O" ring sealed.

The top cover 205 of the case 200 is sealed (e.g., it may be welded). The top cover 205 may have a hole which provides an opening which is sealed by installation of a Fresnel Lens that focuses Infrared Radiation on the PIR Sensor. The Lens may be covered by a Plastic Infrared Filter Window 255, which also serves to seal the top cover 205 against the entry of water. The Motor 150 may be installed from an opening in the Base 210, which may be covered by a Plate and/or a cemented gasket. This gasket may be further held in place by the Seat Bolts, which force the entire assembly against the Toilet Bowl, again reinforcing the Seal against entry of water.

In a further embodiment, as shown in FIG. 6, the entire cover 205 is held down against the base by suitable means. For example, when the cover is held down in this way, all components of the apparatus (e.g., motor, battery, computer circuit board, etc.) can be installed directly on the base without a bottom access hole. The cover can then be removed by lifting it vertically to expose the battery for replacement. In this example, it is not necessary to provide a gasketed plate as no opening for the battery is now required.

In the embodiment shown in FIG. 7, the gear train 241 connecting the Motor 150 to the Lever 230 consists of a Motor pinion 701, a Spur gear 702 driven by the pinion, a Sprocket 703 on the hub of the Spur gear 702, a chain 705 connecting that Sprocket to a second Sprocket 704, located on the Shaft that drives the Lever 230. In such a design, the lifting rotation rate and available lifting torque on the Lever 230 are constant, and independent of the angle of the Lever 230 or the height of the toilet seat 260 above its initial position.

Figure 9:
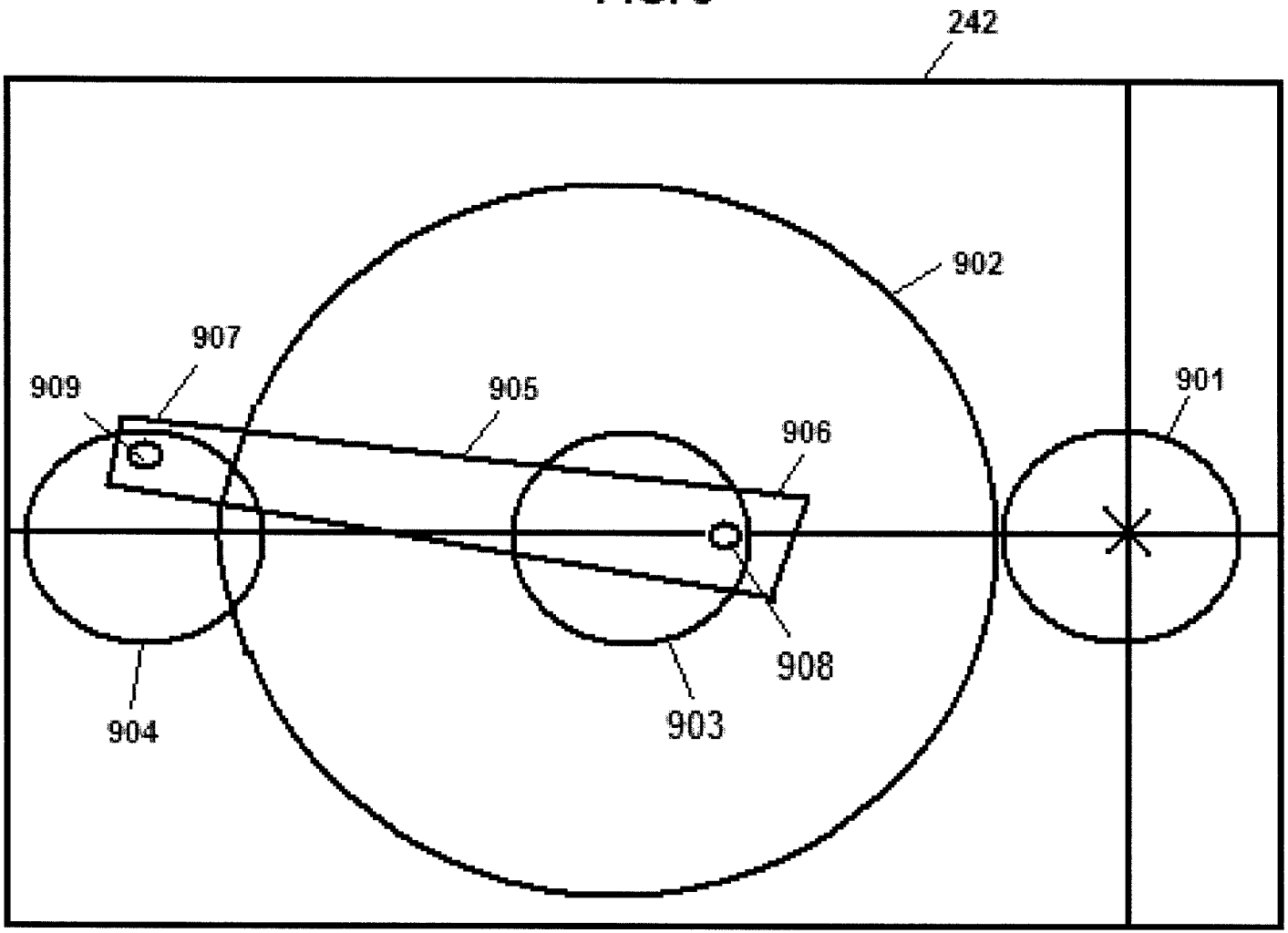
FIG. 9 illustrates a gear train of FIG. 6, according to an exemplary embodiment of the present invention.

However, torque needed to lift the toilet seat is not constant with its angle, but approximately co-sinusoidal, starting with a maximum force when the seat is horizontal, or down, and decreasing to Zero when the seat is vertical. For that reason, a means of providing such a transition of force is desirable. This objective can be obtained by the means described below, in conjunction with FIG. 9. Referring to FIG. 9, a gear train 242 includes a Pinion 901, a Spur gear 902, a Hub 903 (part of the Spur gear 902), and a Hub 904, whose central axis drives the Lever shaft and Lever 230.

Instead of sprockets and chains connecting the two Hubs as in FIG. 7, there is a Connecting Rod 905, which has shaft extensions 906 and 907, each of which enters a bearing 908 or 909 on the respective Hubs 903 and 904, and is capable of rotating within these bearings as the Hubs 903 and 904 rotate.

Note that the relative position of the bearings are such as that when the toilet seat 260 is down, the bearing 908 on the Spur gear Hub 903, is on the horizontal axis, while the bearing 909 on the Lever Shaft Hub 904, is on the vertical axis. Thus, when the driving Hub 903, is rotated counterclockwise by the Motor 150, the driven Hub 904, is in a position to apply maximum torque to its shaft, and the rotational speed will be low, due to the primary act of the Hub 903 is in the lifting phase, not the lowering phase. As the Motor 150 turns the Spur gear 902 counterclockwise at constant rotational velocity, and as the Seat 260 is lifted, Hub 904 transitions to positions of lower torque, consistent with the declining force need to lift the seat as it becomes more vertical, but of higher velocity. But, it eventually reaches a point where the two hubs 903 and 904 complete a 90 degree rotation, with the seat 260 now lifted to the vertical position, and where the stall sensor 146 will stop the motor 150, terminating the lifting phase. Accordingly, this configuration delivers its highest torque when it is needed to start lifting the seat from its initial horizontal position, and then increases the lifting velocity to complete the lifting cycle in a shorter time.

Figure 10:
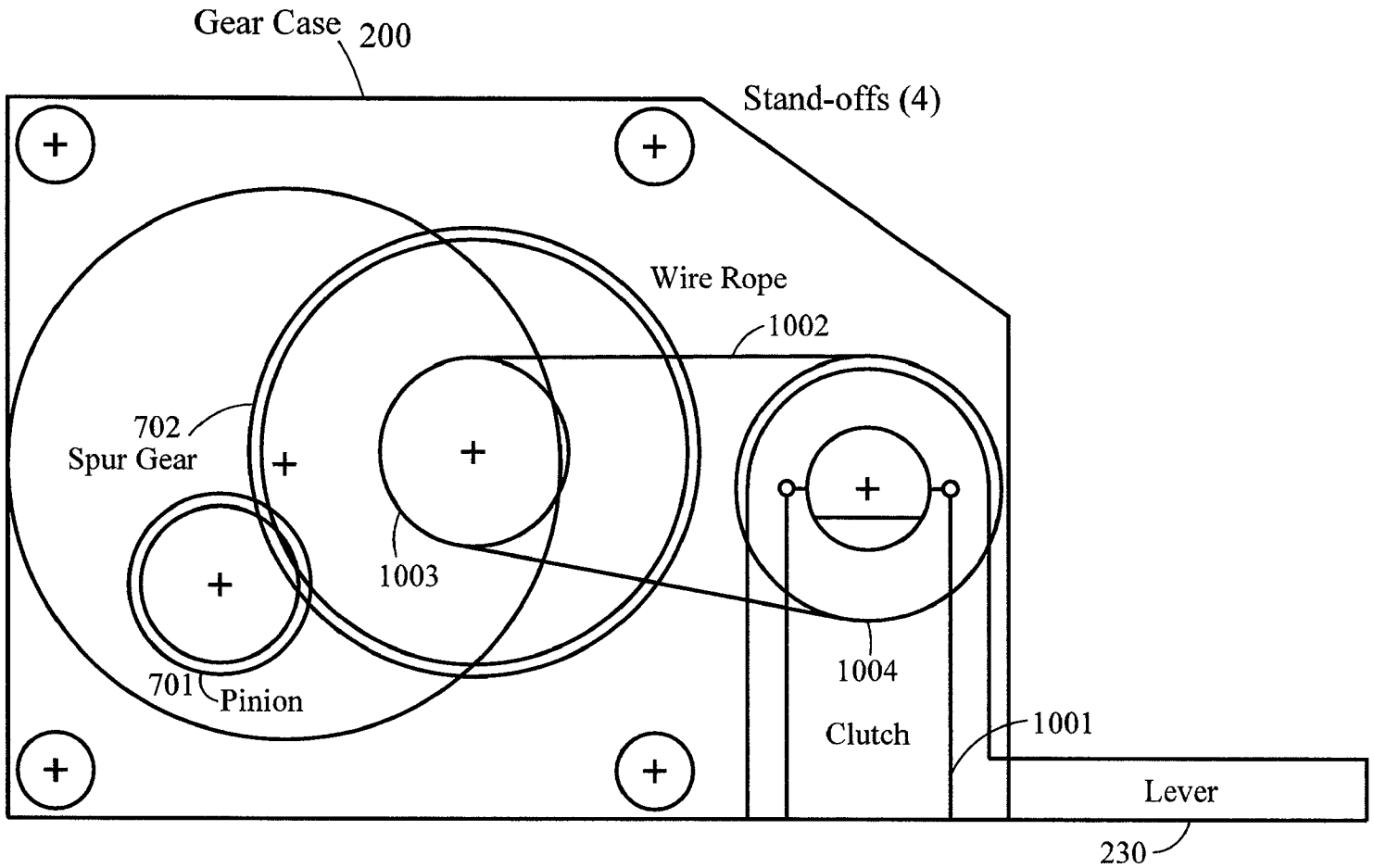
FIG. 10 illustrates a gear train of FIG. 6, according to an exemplary embodiment of the present invention.

FIG. 10 illustrates a gear train of FIG. 6, according to an exemplary embodiment of the present invention. Similar to FIG. 7, the gear train includes a motor pinion gear 701 interfaced with a spur gear 702. A hub 1004 of a shaft coupled to the lever 230 by a clutch 1001 is attached to a hub 1003 of the spur gear 702 by a wire rope 1002. The wire rope 1002 may be secured to the hub 1003 by wrapping a loop of the wire rope 1002 around the hub 1003 and pinning the loop to the hub 1003 using a screw. The wire rope 1002 may be secured to the other hub 1004 in a similar manner. The wire rope 1002 enables the lever 230 to move in a range of about ninety degrees. For example, rotation of pinion gear 701, rotates the spur gear 702, which in turn rotates the wire rope 1002, which in turn rotates the hub 1004 of the shaft, thereby lifting or lowering the lever 230.

Figure 11:
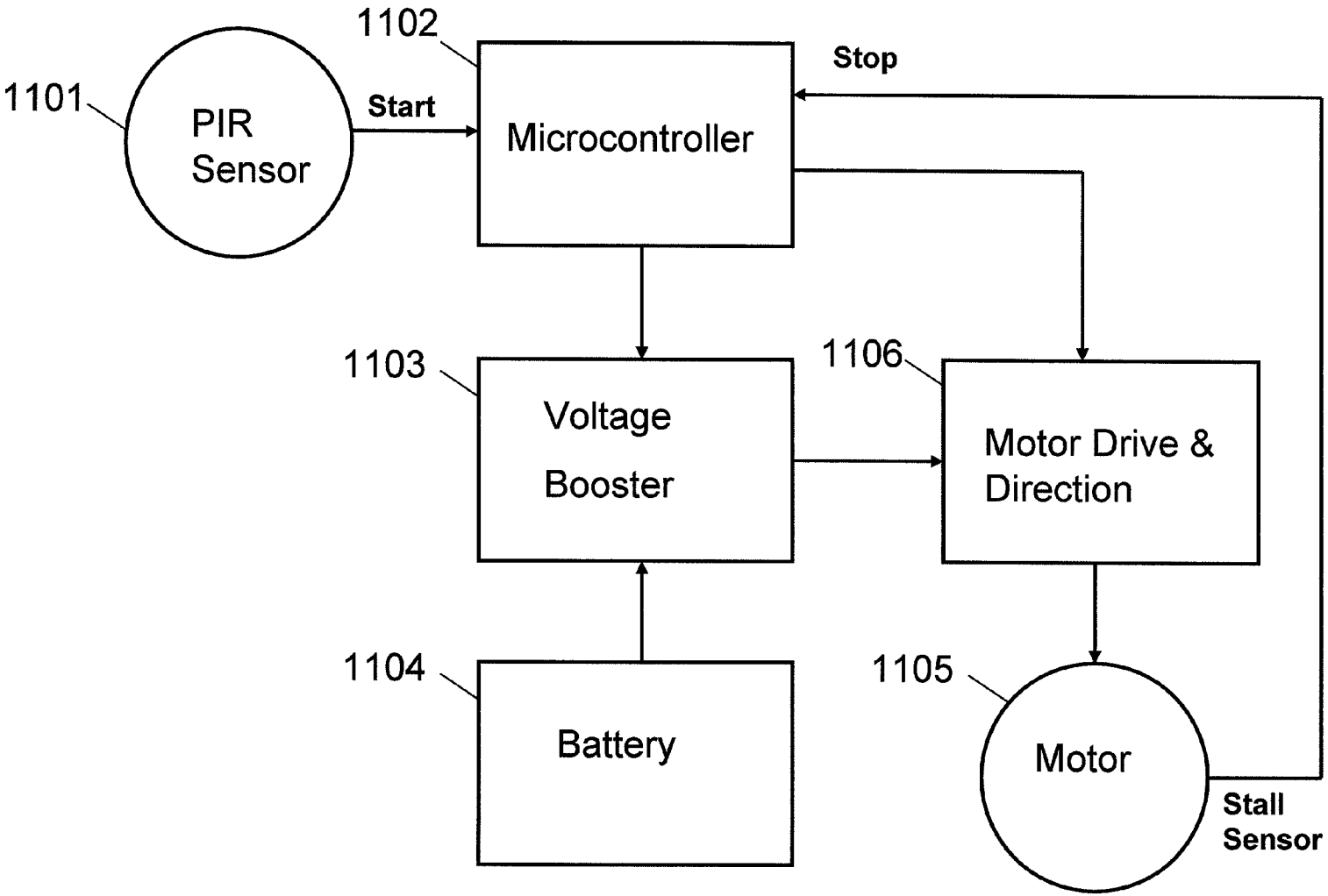
FIG. 11 illustrates a block diagram of a device for lifting and lowering a toilet seat according to an exemplary embodiment of the invention.

FIG. 11 illustrates a block diagram of internal components of a device for lifting and lowering a toilet seat according to an exemplary embodiment of the invention. Referring to FIG. 11, the device includes a PIR Sensor 1101, a microcontroller 1102, a voltage booster 1103, a battery 1104, a motor 1105, and a motor driving unit 1106. The outer case of the device is configured to be mounted to the toilet using the existing mounting bolts of the toilet seat assembly such that a lever driven by the motor 1105 is positioned underneath the toilet seat assembly of the toilet.

The PIR 1101 senses motion (e.g., from a waving hand) and outputs a signal corresponding to the sensed motion to the microcontroller 1102. The microcontroller 1102 analyzes that signal to determine whether the signal meets a starting criteria. If the starting criteria is met, the microcontroller 1102 sends an enable signal to the voltage booster 1103 to deliver a boosted voltage to the motor driving unit 1106. The microcontroller 1102 may periodically enable and disable the enable signal so that the booster 1103 delivers the voltage in an on-off duty cycle ratio such that the average voltage sets the motor speed 1105 to lift or lower the seat in a constant amount of time, independent of the weight of the seat or hinge friction (e.g., within 1 second). If conditions change, the device can be configured to adjust this average voltage to maintain constant lifting and lowering periods. When the seat has been lifted or lowered to its final destination, the current output by the motor 1105 to the microcontroller 1102 indicates a stall and the microcontroller 1102 stops enabling the voltage booster 1103 and disables the motor driving unit 1106.

The voltage booster 1103 is optional. When the voltage booster 1103 is not present, the battery 1104 provides power directly to the microcontroller 1102 and the motor driving unit 1106. Although not shown in FIG. 11, the PIR 1101 may receive power from the battery 1104 or the voltage booster 1103.

The microcontroller 1102 may contain a high frequency clock so that the counting of the clock pulses between any two events permits measurement of the time between events. The microcontroller 1102 starts a lift/lower cycle when it receives an acceptable signal from the PIR 1101 and stops the lift/lower cycle when it receives the stall signal. Thus, the time between the start and stop (e.g., a lifting period and/or a lowering period) can be measured precisely and stored within the microcontroller 1102 for making adjustments to the duty cycle. For example, suppose that is desired that the entire cycle (e.g., a single lifting or lowering period) should take 1 second. If the speed of the motor 1105 is controllable, it is possible to set the motor drive voltage so that its average speed during any lift or lowering cycle takes exactly the same amount of time. However, motor speed is dependent not only on the drive voltage, but also on the weight of the seat and hinge friction, which may change over time.

In an exemplary embodiment of the invention, the device has a dynamically adjusting motor drive voltage control to assure that the desired lift or lowering time is set and maintained, independent of the seat conditions. For example, the microcontroller 1102 may be configured to retain (store) a preset lifting and/or lowering period and count actual lifting and lowering periods, and on each lift or lowering cycle, the microcontroller 1102 can determine if the actual lifting or lowering period is shorter or longer than desired. If it is longer, the microcontroller 1102 can reduce the average voltage, and vice versa. As shown in FIG. 11, the motor drive voltage is produced by the voltage booster 1103, which produces enough voltage to drive a seat of maximum weight and friction at a speed high enough to cycle in less than the required time. This means that to meet the required time, the average voltage must be reduced, which can be accomplished by turning off the drive voltage for a sufficient time, during the cycle, so that the average voltage is just right to meet the timing criteria.

As shown in FIG. 11, the voltage booster 1103 has an enable input, controlled by the microcontroller 1102. Thus, if the microcontroller desires to reduce the voltage, it outputs an enable signal to the enable input to shut off the voltage booster 1103 to achieve the desired result, which is evident in its ability to actually measure the cycle time that results. The microcontroller 1102 remembers a value that results in the average time of the last several cycles being correct, and changes that value automatically if seat conditions change. The value is expressed by controlling the percentage of On and Off duration times (pulse widths) of the voltage booster 1103, to set the average voltage to what is needed to fulfill the time specification.

In at least one embodiment, the On/Off duty cycle is repeated many times during the Lift/Lower Cycles, such that the ratio of On to Off meets the average voltage needed to meet the time requirement. In an alternate embodiment, the ratio of On to Off is varied so that near the end of the cycle the Off periods become more frequent than the On cycles. For example, one can increase the On to Off ratio at the beginning and middle of the cycle so as to maintain the correct average On to Off ratio. Accordingly, while the cycle time is maintained to the specified value, the lifting or lowering is slowed down near the end of the cycle, giving the seat a softer landing.

Figure 12:
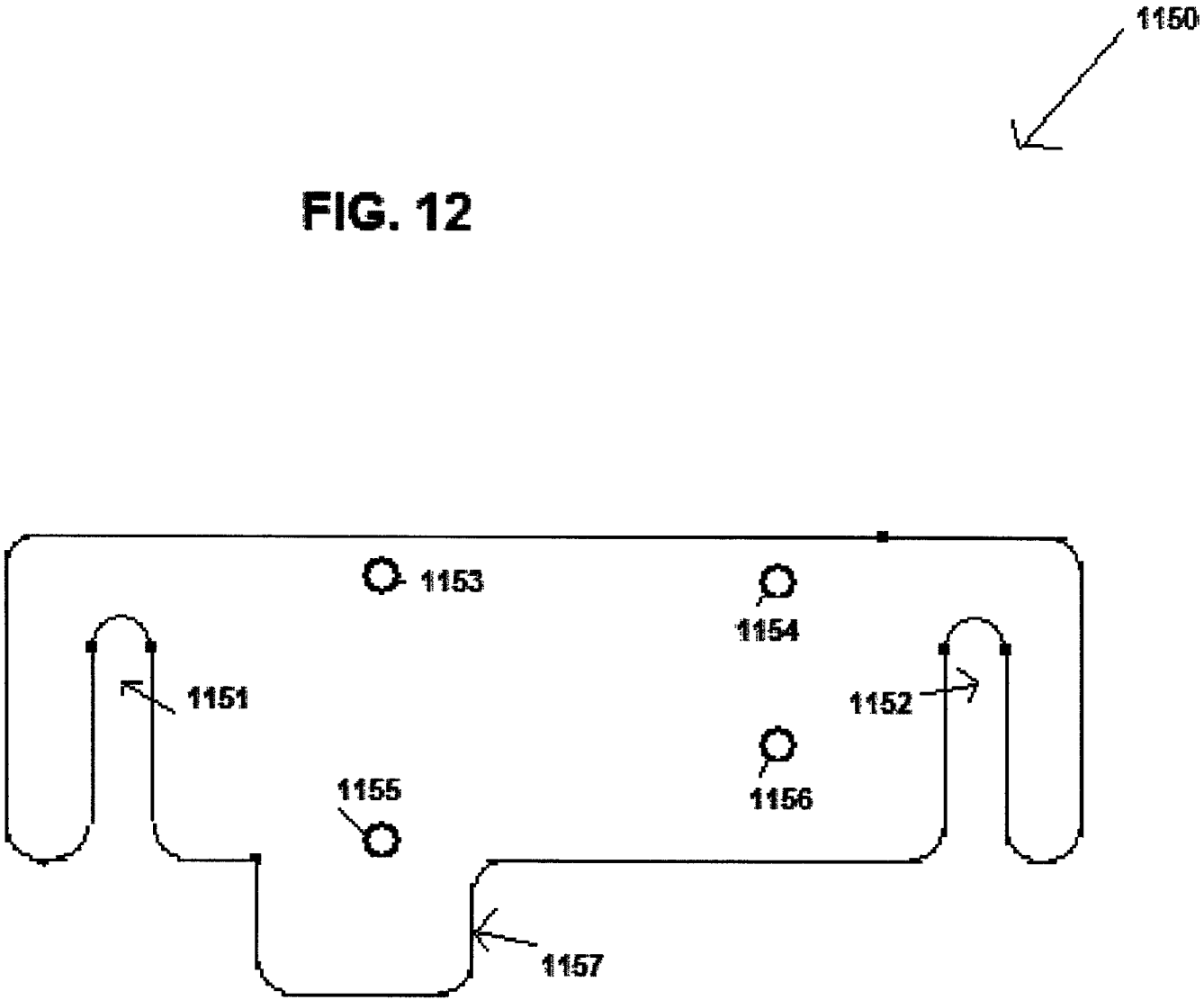
FIG. 12 illustrates a base of the device according to an exemplary embodiment of the present invention.

FIG. 12 illustrates a base 1150 of the device according to an exemplary embodiment of the present invention. Referring to FIG. 12, the base 1150 includes slots 1151 and 1152, which are separated from one another by a separation distance. For example, in at least one exemplary embodiment of the present invention, the separation distance is about 5.5 inches. However embodiments of the present invention are not limited to any particular separation distance, and may be varied according to industry or country standards.

The slots 1151 and 1152 are open at one end so that the device may be slid under mounting bolts of a toilet seat assembly without removing the toilet seat from the toilet itself, which is accommodated by the thickness of the base 1150. For example, in at least one embodiment of the device, the base 1150 has a thickness of about ⅛ of an inch. In this way, merely loosening the bolts by turning the hand operated nuts permits the base 1150 to be slid under the seat assembly. Further, since the base 1150 is relatively thin, it allows the device to be installed without materially altering the angle of the toilet seat on the toilet, which helps to maintain the seat manufacturer's design intention. In at least one embodiment of the device, the base 1150 is made of stainless steel or corrosion protected carbon steel. The base 1150 may include four metal flat head screws 1153-1156 for mounting a gear case (not shown) to the base 1150. The gear case will be described in more detail below. The gear case may be mounted to the base in ways other than the screws (e.g., using less or more than the four screws or by an entirely different method).

The base 1150 may have an extension 1157. The extension 1157 may be somewhat rectangular in shape. In at least one embodiment of the invention, the outer case of the device (not shown), fits between the top edge of the base 1150 and the bottom edge of the extension 1157, and does not extend beyond the slots 1151 and 1152. The outer case will be discussed in more detail below.

Figure 13:
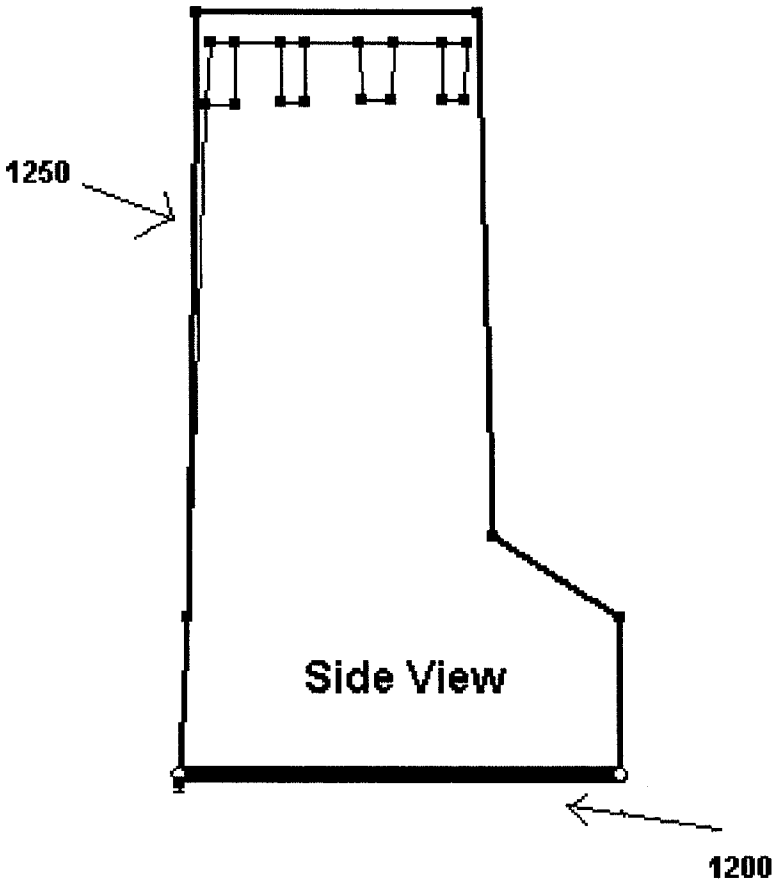
FIG. 13 illustrates an outer case of the device according to an exemplary embodiment of the invention.
Figure 13:
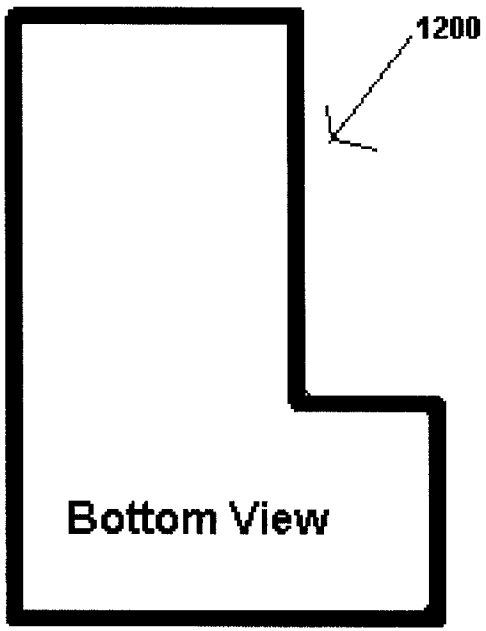

FIG. 13 illustrates a gasket 1200 and an outer case 1250 of the device according to an exemplary embodiment of the invention. The gasket 1200 is attached between the base 1150 and the outer case 1250. As shown in FIG. 13, the gasket 1200 is represented by a bold line, while the outer case 1250 is represented by a thinner line. The gasket 1200 may be made of a compressible material, which is compressed when the outer case 1250 is installed on the base 1150 to seal the interior, thereby preventing entry of liquids.

Figure 14A:
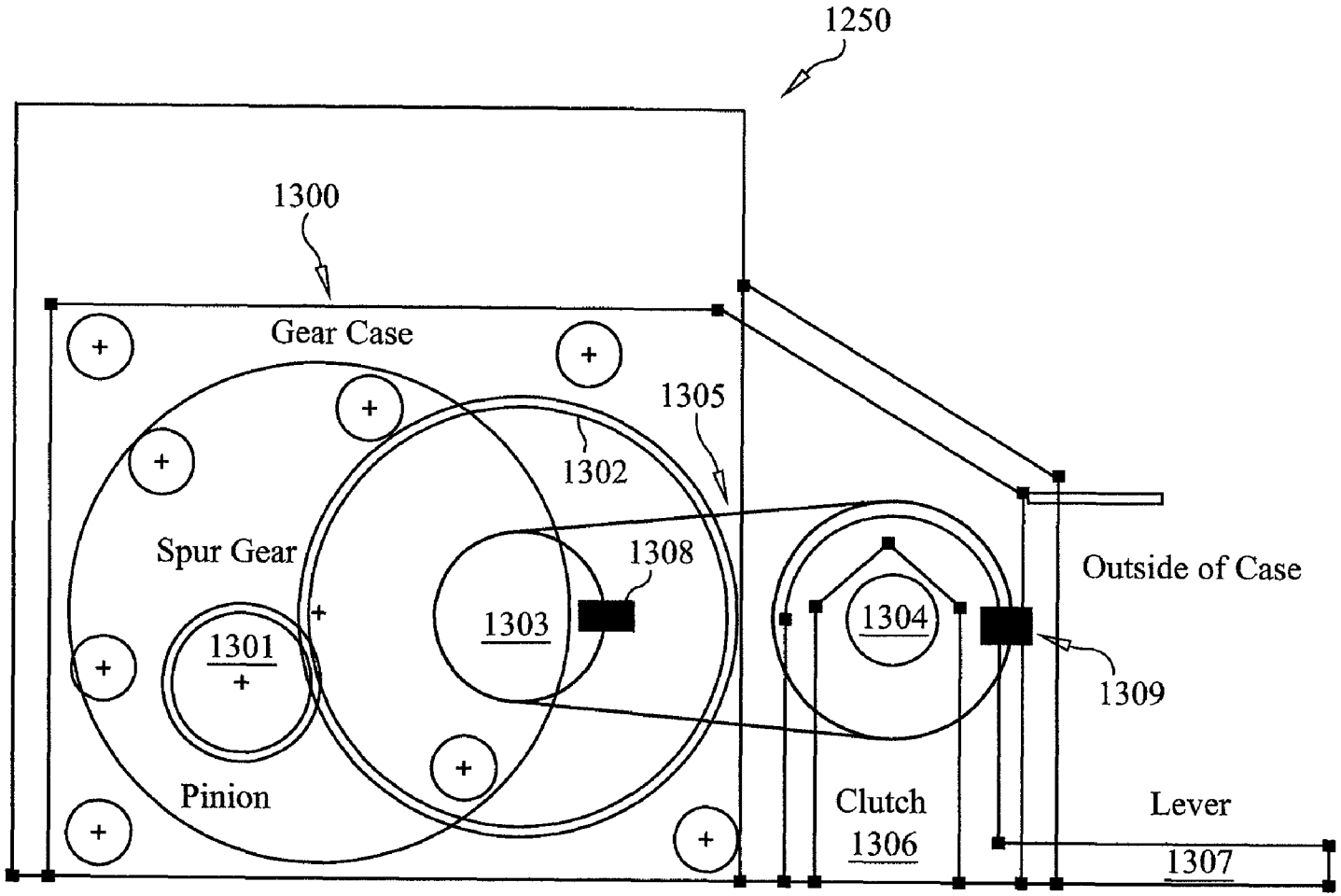
FIG. 14A illustrates a drive mechanism of the device according to an exemplary embodiment of the present invention.
Figure 14B:
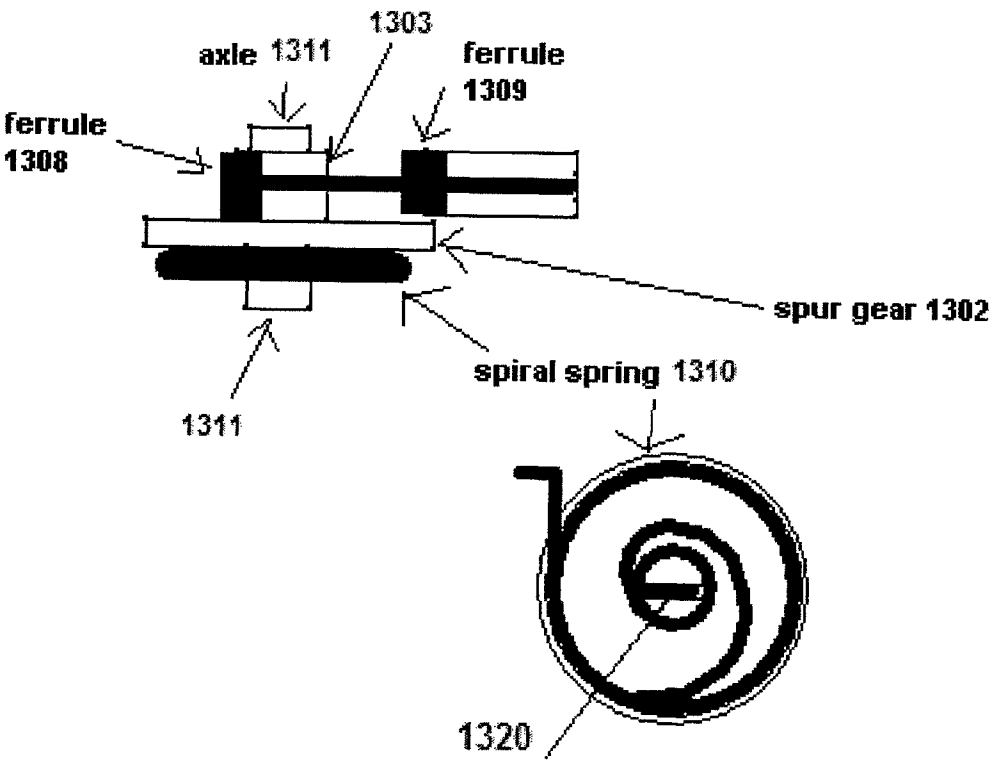
FIG. 14*b* illustrates a part of the drive mechanism that uses a spiral spring according to an exemplary embodiment of the invention.

FIG. 14A illustrates the device according to an exemplary embodiment of the invention. Referring to FIG. 14A, a gear case 1300 having a drive system is included within the outer case 1250. The drive system includes a motor pinion gear 1301 interfaced with a spur gear 1302. The motor pinion gear 1301 is connected to a shaft of a motor (not shown). A hub 1303 of the spur gear 1302 is attached to a hub 1304 of an output shaft by a wire rope 1305. The hub 1304 is connected to a clutch 1306 that is coupled to a lever 1307. In at least one embodiment of the invention, the wire rope 1305 is secured to the hubs 1303 and 1304 by wrapping part of the wire rope 1305 completely around the entire circumference of one of the hubs (e.g., 1303), wrapping another part of the wire rope 1305 around a single end of the other hub (e.g., 1304), and crimping each end in place to its respective hub using a corresponding one of ferrules 1308 and 1309. The wire rope 1305 enables the lever 1307 to move in a range of about ninety degrees. For example, rotation of the pinion gear 1301 rotates the spur gear 1302, which in turn rotates the wire rope 1305, which in turn rotates the output shaft, thereby lifting or lowering the lever 1307. FIG. 14*b* shows an example of a connection between the hub of the spur gear 1302 and the hub 1304 of the output shaft. A spiral spring 1310 and the spur gear 1302 rest on an axle 1311 and the spiral spring 1310 is affixed to an arbor (a slot) in the axle 1311. In an alternate embodiment of the invention, the 1310 spiral spring is located between the hub 1304 and the output shaft.

Figure 15:
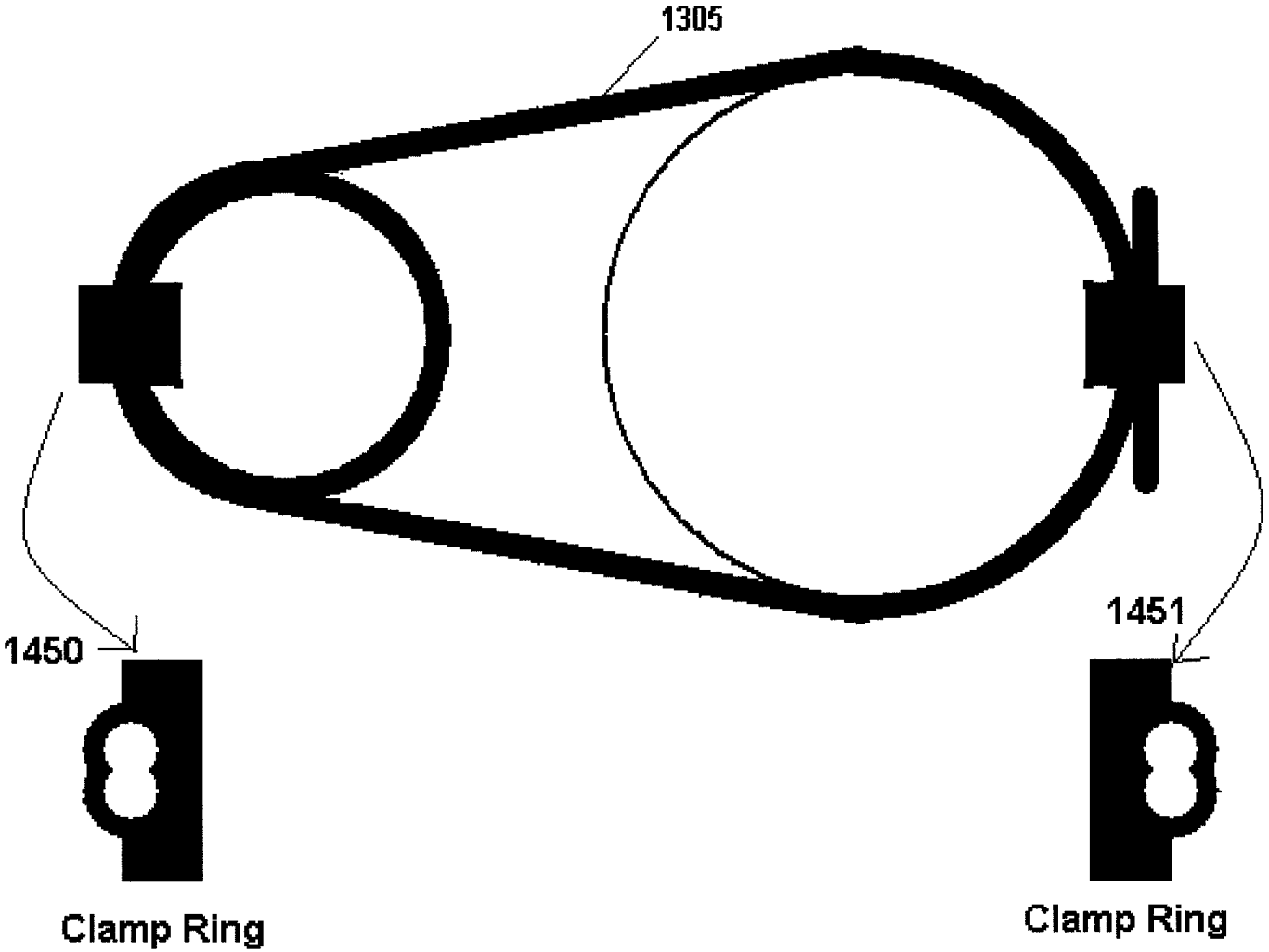
FIG. 15 illustrates a wire rope connection of the drive mechanism according to an exemplary embodiment of the invention.

FIG. 15 shows another method for affixing the wire rope 1305 to the hubs 1303 and 1304. Instead of using flat ferrules, the wire rope is affixed using a pair of clamp rings 1450 and 1451. A square or rectangular shaped portion of each of the hubs 1303 and 1304 may be cutout to allow the straight side of each corresponding one of the clamp rings 1450 and 1451 to be fit into place. The curved portion of each of the clamp rings 1450 and 1451 oppose one another and protrude away from the respective hubs 1303 and 1304. Each of the clamp rings 1450 and 1451 has an opening that resembles two overlapping circles or ellipses. The diameter of each these circles/ellipses is sufficient to receive a separate loop of the wire rope 1305. A first loop of the wire rope 1305 may be fed through a circle/ellipse of the second clamp ring 1451, and a second loop of the wire rope 1305 may be fed though the other circle/ellipse of the second clamp ring 1451. The wire rope 1305 may be connected to the first clamp ring 1450 in a similar manner. If the wire rope 1305 is not wrapped around an entire circumference of the spur gear 1303 (e.g., only around one side), a clamp ring with an opening shaped as a single circle/ellipse may be used instead of the first clamp ring 1450. The curved side of the clamp rings is made of a compressible metal, which is compressed (e.g., crimped) to lock the rings around the wire rope 1305.

Figure 16:
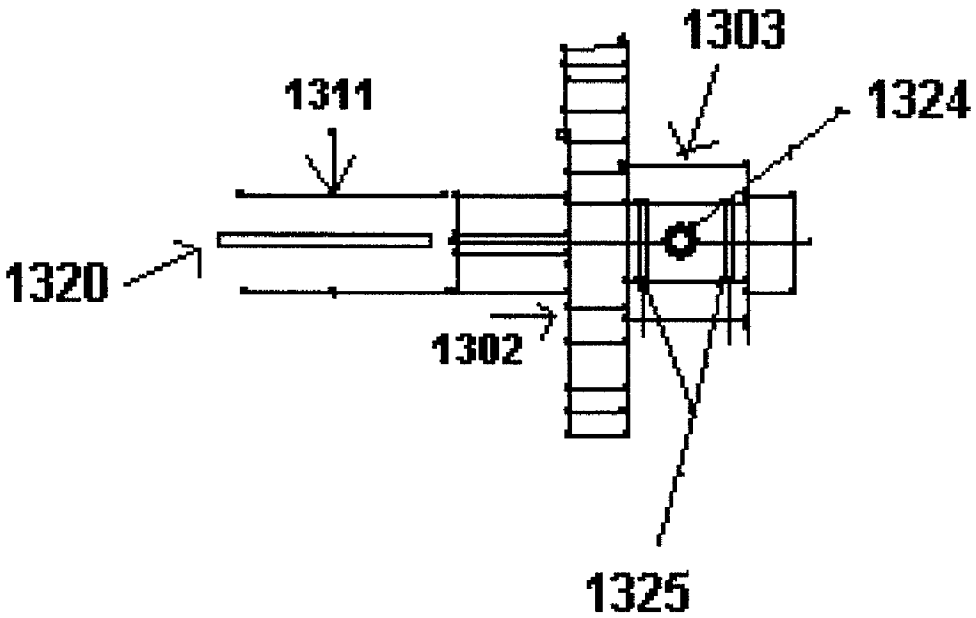
FIG. 16 illustrates a portion of the drive mechanism that allows the wire rope to be secured according to an exemplary embodiment of the invention.
Figure 17:
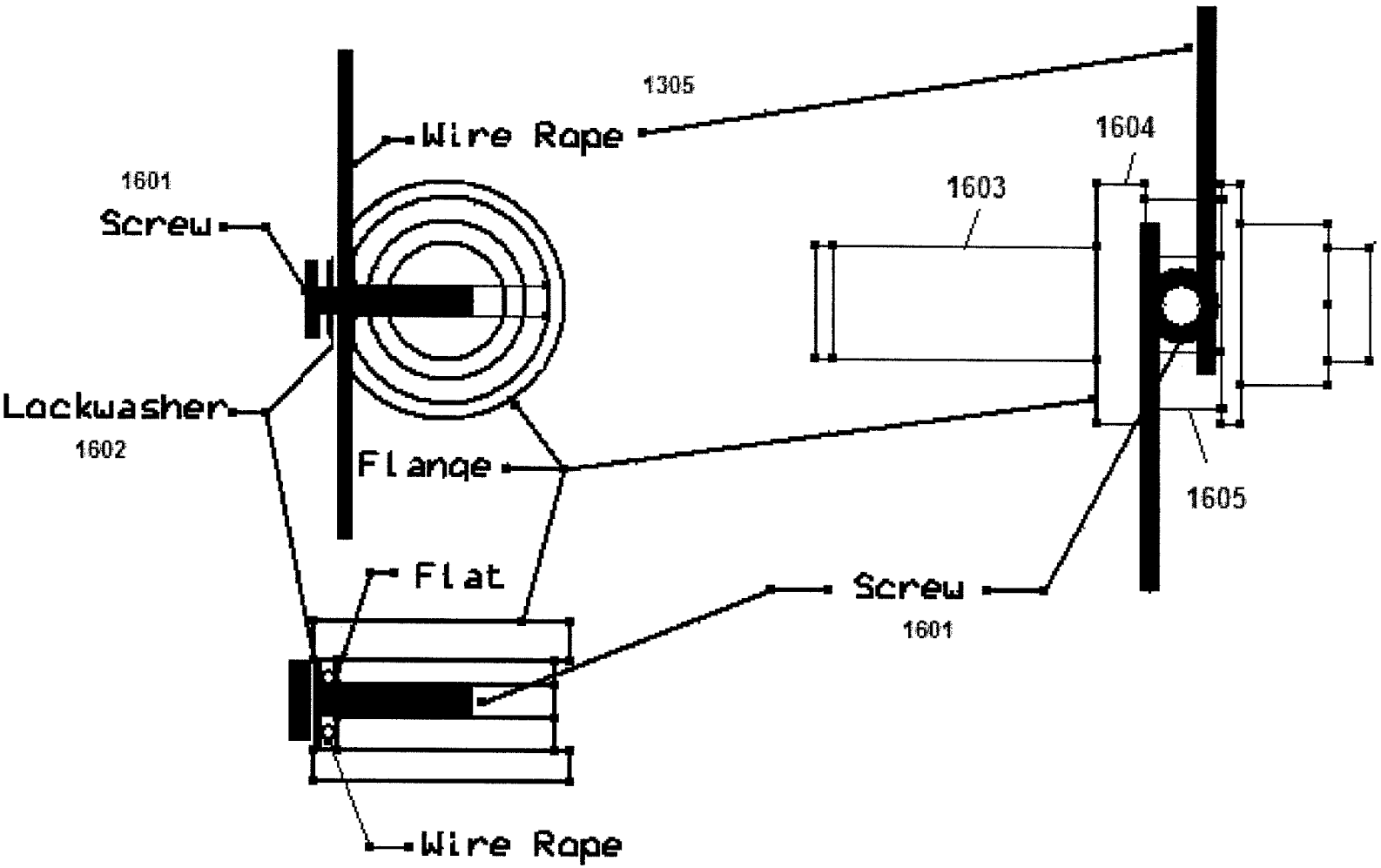
FIG. 17 illustrates a portion of the drive mechanism that allows the wire rope to be secured according to another exemplary embodiment of the invention.

FIG. 16 shows a spur gear 1302 whose hub 1303 has been modified according to an exemplary embodiment of the invention to allow for the wire rope 1305 to be secured thereto. The hub 1303 has two opposing channels 1325 and a screw hole 1324 disposed between the channels. A part of the wire rope 1305 is threaded through and rests within each of the channels 1403. A screw (not shown) is then screwed into the screw hole 1324 to pin the wire rope 1305 in place. The hub 1304 of the output shaft can be modified in a similar manner to allow the other end of the wire rope to be secured thereto. FIG. 17 shows an enlarged view of the connections shown in FIG. 16. The hub 1604 may be the hub of the spur gear 1302 or the hub 1304 of the output shaft. The hub 1604 rests on an axle 1603. Two parts of the wire rope 1305 are fed through the channel 1605 to the left and right of a hole (not shown) in the hub 1604 that receives the screw 1601. A lock-washer 1602 may be placed between the screw 1602 and the wire rope to ensure a tighter connection.

The above described ferrules/clamp rings/screws may be used to tether the wire rope 1305 to deliver torque to the hub 1304 of the output shaft. The use of the wire rope 1305 may provide a step up in torque of over 3:1 and a like reduction in rotational speed.

The connection of the wire rope 1305 shown above transfers torque from the spur gear 1302 to the output shaft without the need for an extra gear. The required rotation of the pinion gear 1301 and spur gear 1302, associated with the full range of a toilet seat angle rotation, is less than around 180 degrees. Therefore a motor that has sufficient torque, and an internal gear mechanism that permits its output shaft to rotate at around 10 RPM, could couple directly to the spur gear 1302 and lift the seat 90 degrees in a few seconds, depending on the relative hub diameters.

Referring back to FIG. 14B, the spiral spring 1310 is located on the shaft (axle) 1311 of the spur gear 1302 to counterbalance the gravitational force of the toilet seat so that energy derived from the seat when lowered, is stored in the spring for use in lifting the seat when that action is demanded. For example, when the seat is lowered, the spiral spring 1310 is winded tighter and held in the winded state, and then when the seat is to be raised, the spiral spring 1310 is released so it can unwind to deliver a counter force to aid in rotating an axle (e.g., the axle 1311 of the spur gear 1302 or the axle of the output shaft) to raise the seat. The use of the spiral spring 1310 not only lowers the amount of torque that the motor needs to provide, but also reduces the amount of energy the battery needs to provide in the action of lifting and lowering the seat. Since the torque provided by gravity, in lifting and lowering the seat, may vary in a sinusoidal manner with the angle of the seat, and the spring torque may vary linearly, an initial torque is provided by this pre-compressing of the spiral spring 1310. The spring constant of the spring 1310 may be chosen to approximate the sinusoidal seat gravity variation. The use of the spiral spring 1310 may result in a reduction of required motor torque by a factor of approximately 10:1.

Referring back to FIG. 11, the PIR 1101 senses motion (e.g., from a waving hand) to cause the lever to lift and lower the lever according to the motion sensed. The PIR sensor 1101 may sense motion via receipt of light through a window in a top surface of an outer case of the device. For example, the window may be positioned such that only someone waving their hand in a specific region over the toilet seat triggers the device to either lift or lower the toilet seat. The range of the PIR sensor 1101 may be limited to the specific region using a lens.

As discussed above, the microcontroller 1102 analyzes signals it receives from the PIR sensor 1101 to determine whether to lift or lower the lever 1307. The PIR sensor 1101 may include one or more PIR sensors. For example, when a single PIR sensor is used, the seat may alternate between lifting and lowering each time the single sensor is triggered. Alternately, when two PIR sensors are used, the seat may be lifted when the first sensor followed by the second sensor are triggered in succession and lowered when the second sensor followed by the first sensor are triggered in succession.

In an exemplary embodiment of the invention, the microcontroller 1102 is programmed to stop lifting or lowering the seat when an obstruction is encountered, whether it be from the seat naturally reaching the end of its travel, or due to an internal or external obstruction caused by purposeful or accidental personal contact. After stopping the lifting or lowering, the microcontroller 1102 may resume lifting or lowering after a certain period of time has elapsed, or wait for another user command. In a further exemplary embodiment, the device includes an audio and/or a visual alarm and the microcontroller 1102 is programmed to sound the alarm when the microcontroller 1102 starts the seat lifting or lowering. In a further exemplary embodiment, the microcontroller 1102 is configured to use predefined preferences and automatically return the seat to a preferred position based on these preferences. For example, a user may prefer to have the seat always return to a down position when a predefined period of inactivity has elapsed after the seat has been lifted up.

In another exemplary embodiment, the microcontroller 1102 self adjusts seat drive control parameters, such as stall current level based on historical accumulation of operation, such as normal operating current, dependent on the seat's weight and operating friction. By doing this self-adjustment, it may preclude the need for setting or adjusting operating parameters by the installer, who may encounter a great variety of such parameters due to the variation in design and environments between different manufacturers and installation conditions.

In another exemplary embodiment, the microcontroller 1102 is programmed to perform automatic conditioning of a power duty cycle to all internal electronic components to assure minimum use of power, while still maintaining effective sensing of a command (e.g., initiated by hand movement) within the expected duration of such a command. For example, a 3:1 Off-On cycle for the PIR Sensor 1101 would be effective in saving power. In at least one embodiment of the invention, the 'On' time is set to at least 250 milliseconds, and the cycle repetition rate is set at 2 seconds or greater. The device may also be configured to include a manual control that allows a user to select among various performance options. In an exemplary embodiment, the manual control is accessible when the outer case 1250 is removed.

The device includes batteries, which provide power to the components therein (e.g., the microcontroller 1102, motor 1105, PIR sensor 1101, etc.). In an exemplary embodiment of the invention, the device includes an audio and/or visual alarm and the microcontroller 1102 is programmed to alert users that a replacement of the batteries is required or alert a user that a gross change in seat parameters has occurred (e.g., a change in rotational friction of the seat itself).

Figure 18:
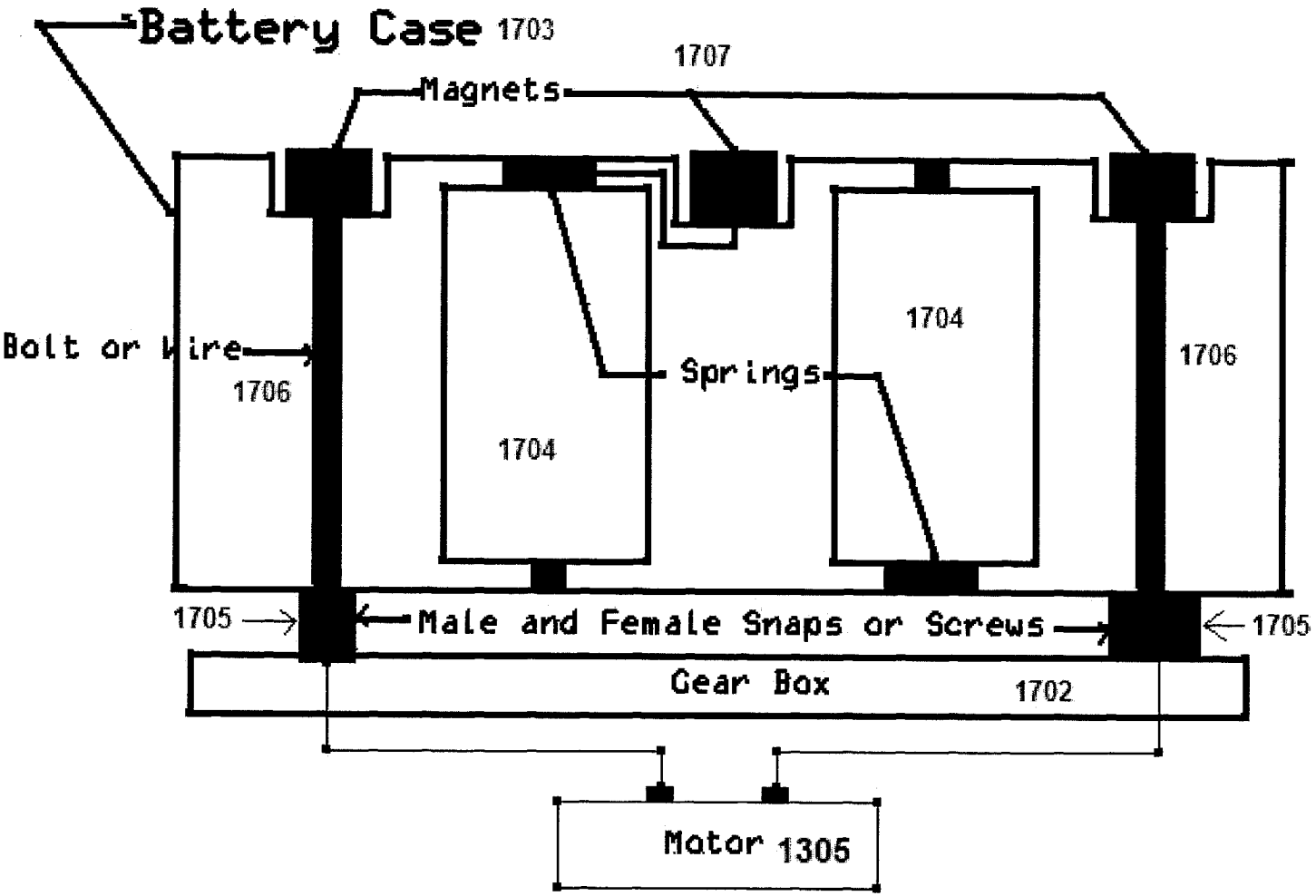
FIG. 18 illustrates a connection between a motor, a gear box, and a battery case of the device according to exemplary embodiment of the invention.

FIG. 18 shows a connection between a motor 1701, a gear box 1702, and a battery case 1703 of the device according to exemplary embodiment of the invention. The battery case 1703 includes batteries 1704 (e.g., 4 "C" size batteries) arranged in a pattern that fits into the limited space (e.g., about 3.75 inches in width and about 2 inches in depth) available between the seat bolt holes. The gear assembly 1300 may be located within the gear box 1702.

The battery case 1703 is removably connected to the gear box 1702 by lifting it off snaps 1705, which may be similar to those used on 9 volt batteries. The mates of the snaps 1705 are secured to the gear box 1702 (e.g., the drive system). This permits the batteries 1704 to be installed away from the toilet itself, or they could be provided as a pre-assembled snap in kit. In an alternative embodiment of the invention, the battery case 1703 is screwed down to the top of the gear box 1702, which is already firmly attached to the base 1150, and subsequently secured to the toilet seat itself.

Connection lines 1706 of the motor 1701, which lie below the battery case 1703, pass through the battery case 1703. The battery case 1703 provides direct pass-through connections, connecting to the motor 1701 leads via two of the snaps 1705, or by direct wiring to the pass-though wires if the battery case 1703 is screwed to the drive system. In this way, the motor wire connections are not exposed when the outer case 1250 is removed to replace the batteries 1704.

Figure 19:
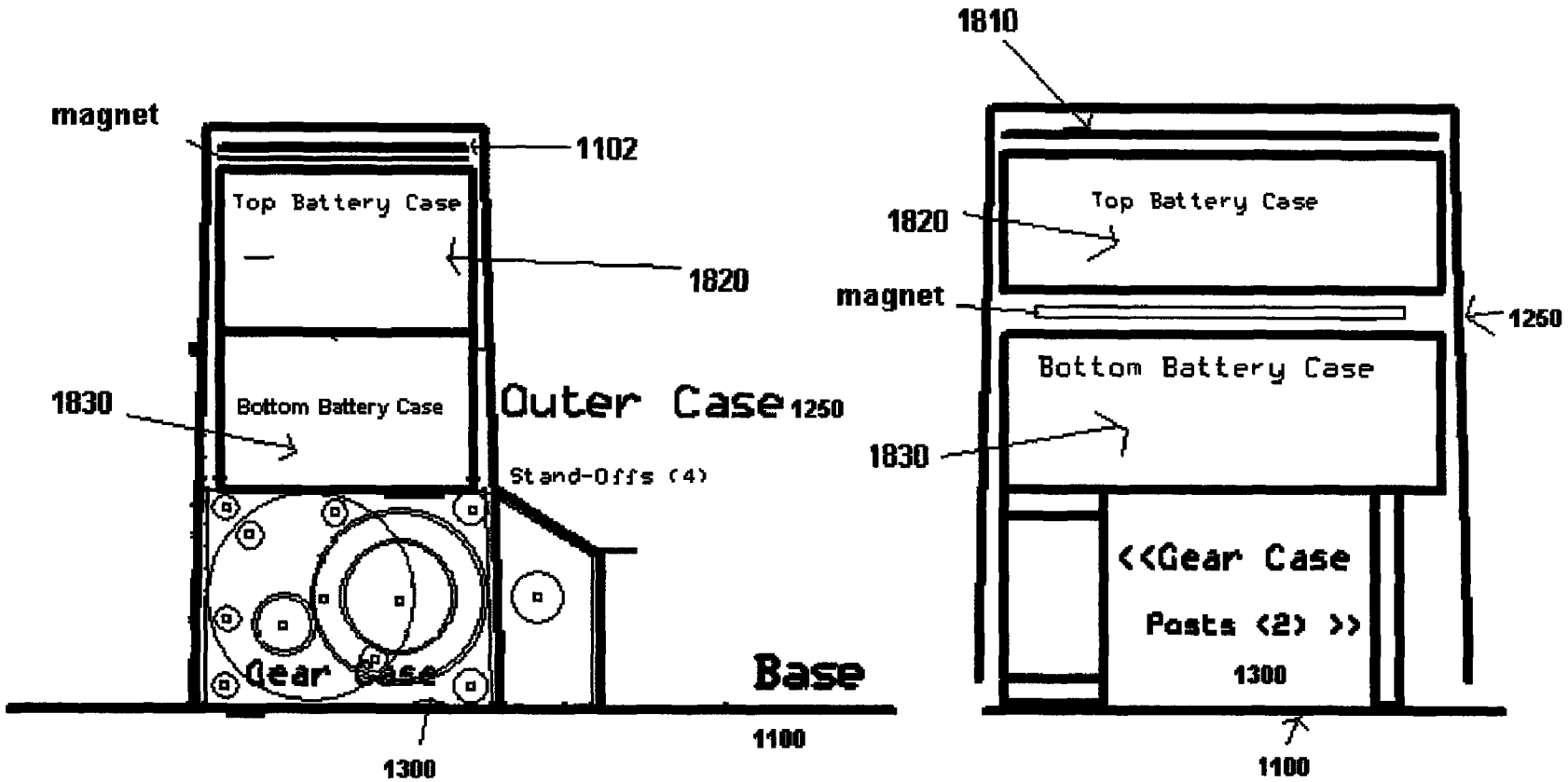
FIG. 19 illustrates connections between inner cases of the device according to an exemplary embodiment of the invention.

Further, the battery case 1703 plays a role in attaching the outer case 1250 to the gear box 1702. As shown in FIG. 19, the microcontroller 1102 is mounted to the inside top of the outer case 1250. The microcontroller 1102 may be mounted using four screws, which, with the battery case 1703 installed, rest against the four corners of the battery case 1703. By equipping the battery case 1703 with magnets 1706 of appropriate strength at these corners, when the outer case 1250 is pressed against the gasket 1200, as the outer case 1250 is fitted over the components, the four magnets attract the four mounting screws 1153-1156 attaching it to the outer case 1250, forcing it down onto the gasket 1200 and the base 1150 on which it is mounted. Thus, the outer case 1250 is secured as a sealed cover over the interior of the device. When it is necessary to remove the outer 1250 case for battery replacement, the outer case 1250 may be grasped by hand and lifted up, overcoming the magnet attractive force. For example, magnets 1706 may be chosen such that not more than 5 pounds of force are required, which is well within the capacity of humans.

The battery case 1703 includes a top battery case 1820 and a bottom battery case 1830. The outer case 1250 is attached to the upper battery case 1820 and the microcontroller 1102, and the lower battery case 1830 is attached to the gear case 1300 and the base 1150. Two locations on the battery cases 1820 and 1830 may include Neodymium magnets placed in opposing positions, at opposite ends of their structure. The magnets serve to apply a force directed to hold the battery cases 1820 and 1830 together; this force being transferred to the outer case 1250, also serving to force the outer case 1250 down to keep the entire assembly closed. The force of the magnets 1706 should exceed the opposing forces of the battery springs and the gasket 1200, which seals the outer case 1250 over the entire assembly. Thus, to remove the outer case 1250 to access the batteries 1706 for replacement, it is only necessary for the outer case 1250 to be gripped and pulled upwards. The battery cases 1820 and 1830 also provide contacts for the pass-through of the Motor connections, so that when the batteries 1706 are being replaced, no wires or other connections are encountered.

Figure 20A:
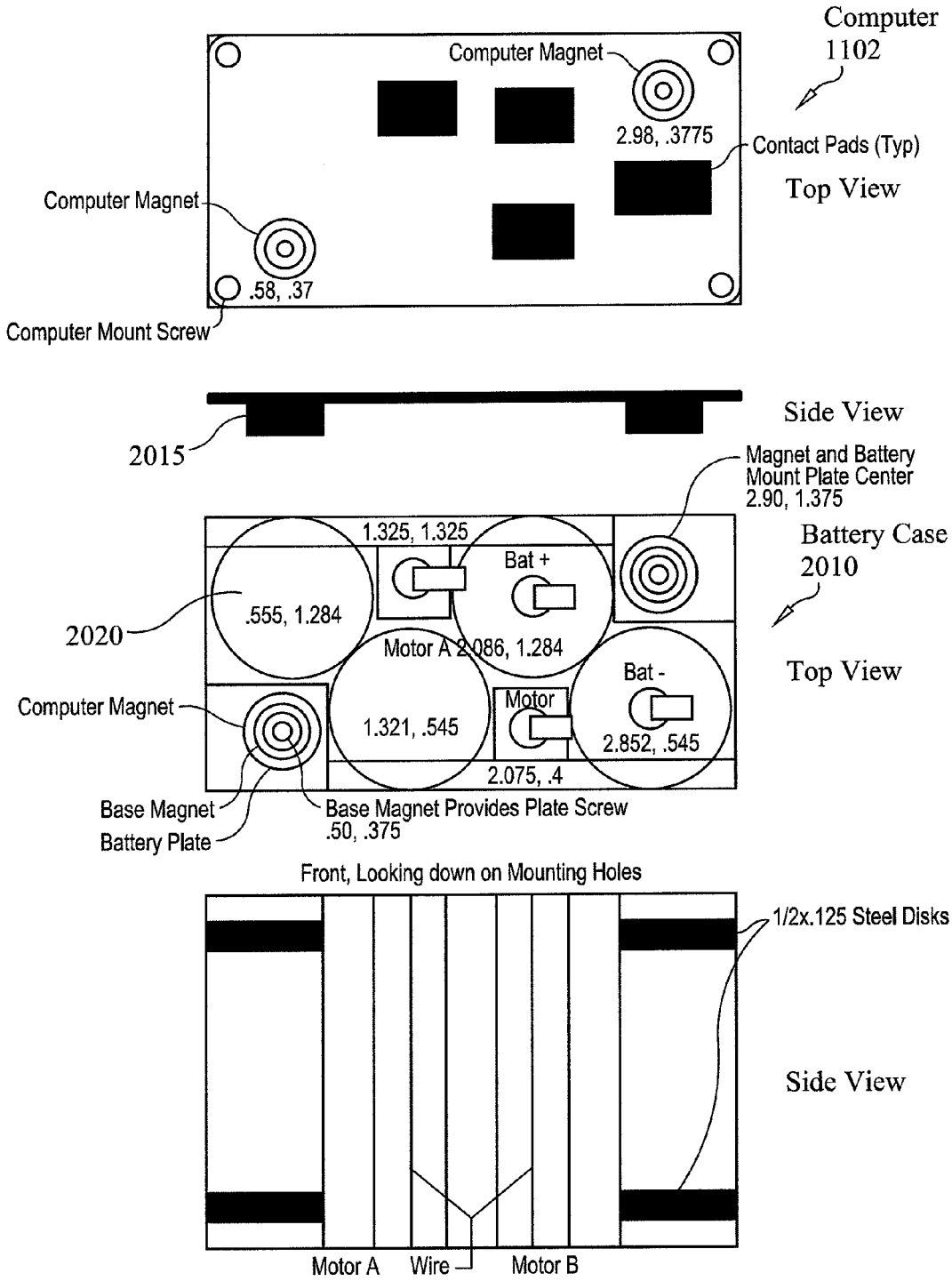
FIG. 20A and FIG. 20B illustrates connections between components of the device according to an exemplary embodiment of the invention.
Figure 20B:
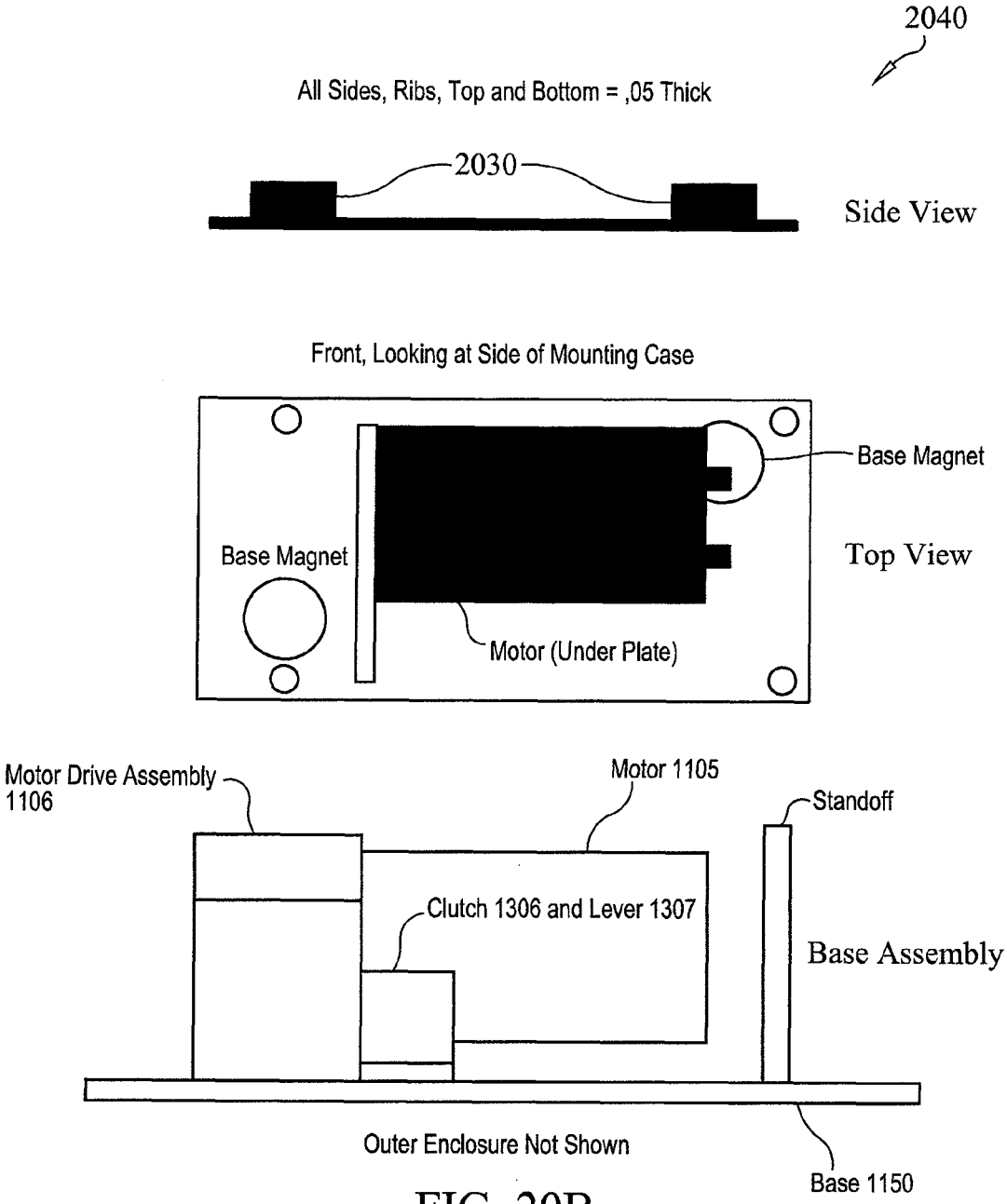

FIG. 20A and FIG. 20B illustrate another method of securing the components of the device together according to an exemplary embodiment of the invention. FIG. 20A and FIG. 20B illustrate top and side views. The top view is looking down on the case and shows four circles representing the tops of the batteries 2020 (e.g., four C batteries). Also shown are four spring connectors, which engage contact areas on the bottom of the microcontroller 1102 (not show), which are assembled above the case. Two of these terminals deliver voltage (e.g., +6 volts) and a ground from the batteries to the microcontroller 1102. The other two terminals deliver a motor drive voltage, which passes through the case, and emerge on the bottom to two similar spring connectors, which deliver this voltage to the battery mount 2040, which in turn applies this voltage to the motor 1105, which lies below the battery 2020. The top view also shows two rectangles in opposite corners. Inside of these are circles representing steel disks that are attached to the top and bottom of the battery case 2010 to attract the magnets 2015 that are mounted to the lower side of the microcontroller 1102 and the magnets 2030 that are mounted to the upper side of the battery mount 2040. These hold the assembly together, but a good tug will release them so that the outer enclosure can be lifted off, giving access to removal of the battery case 2010 for replacing the batteries 2020. The side view shows the contacts and the wires connecting the upper battery drive voltage to the lower drive voltage connectors. As can be seen, the entire battery case 2010 can be removed from the battery mount 2040 by pulling upward to release the lower steel disks from the magnets. The outer case (not shown) encloses the microcontroller 1102, the battery case 2010, the battery mount 2040, and the base assembly making contact with the base 1150. The microcontroller is permanently affixed to the inside top surface of the outer case, and thus the outer case along with the microcontroller 1102 are removable by pulling on the outer case with a force exceeding the magnets 2015.

Figure 21:
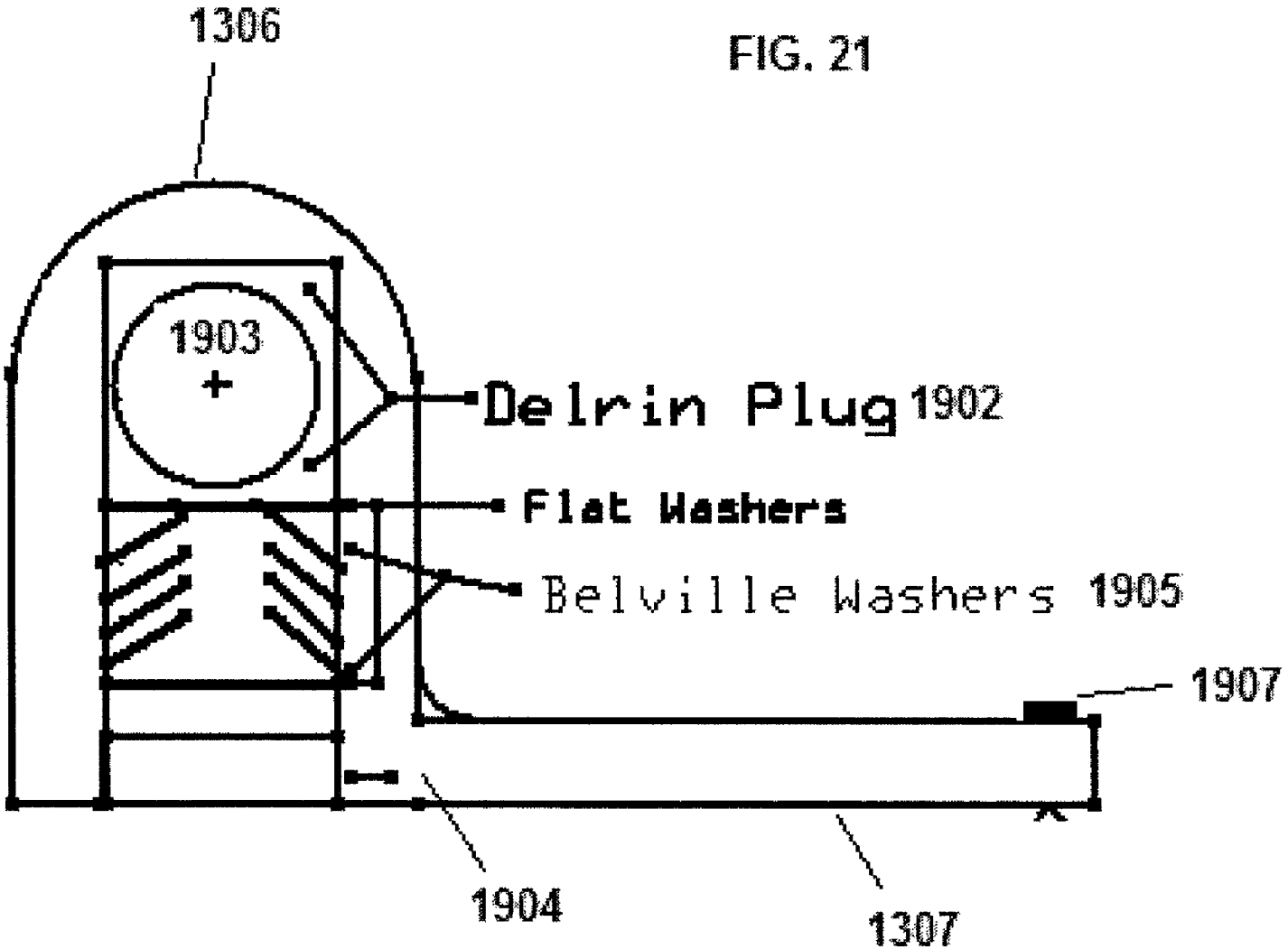
FIG. 21 illustrates the clutch of the device according to an exemplary embodiment of the invention.

FIG. 21 shows the clutch 1306 and the lever 1307 according to an exemplary embodiment of the present invention. A hole is drilled in the clutch 1306 and filled with a suitable clutch material (e.g., Polyoxymethylene, which is manufactured by the DuPont Corporation under the trade name Delrin™) to generate a plug 1902. The diameter of the plug 1902 is greater than the diameter of the output shaft 1903. After the clutch 1306 has been filled with the clutch material, a hole is drilled through the clutch 1306 to permit the shaft 1903 to be pressed through the plug 1902, to maintain close contact with the plug 1902. Since the plug 1902 has a greater diameter than the shaft 1903, when pressure is applied to the lower end of the plug 1902 to increase the force on the shaft 1903, that pressure is transmitted through the continuity between the far end of the plug 1902 provided by the greater diameter of the plug 1902 than the shaft 1902. This results in an equal normal force on the shaft 1902 over its entire contact with the plug 1902, as needed to obtain sufficient frictional torque to lift the toilet seat.

By adjusting a compression bolt/screw 1904 on the bottom of the clutch 1306, the normal force may be adjusted so that the clutch 1306 releases before a destructive torque is applied back to the gear assembly by inadvertent force applied to the toilet seat. The compression screw 1904 can be rotated to press firmly against the plug 1902 so as to increase its internal pressure to such a degree that normal force of the plug against the cylindrical circumference of the shaft 1903 produces a frictional torque sufficient to lift the seat, but less than is required to slip if an excessive external force is applied to the seat. This will prevent a torque higher than the motor 1701 can handle from being applied backwards, via the drive system, which might otherwise destroy the gears of the motor 1701. The plug 1902 completely surrounds the output shaft 1903, transmitting the pressure level created by the adjustment screw 1904 normally on all cylindrical surfaces of the shaft 1903 in contact with the plug 1902. This may assure stability of pressure adjustment, since there are no relief areas in which the plug 1902 could gradually expand into to change the calibration. The resultant friction force which the clutch 1306 could withstand at the point of release is the product of the friction factor of the plug 1902, multiplied by the area of contact between the plug 1902 and the output shaft 1903.

A compressive force may be applied against the plug 2101 through a set of washers 1905 (e.g., Belville, Clover Leaf, etc.) to stabilize the pressure of the plug 1902 so that it is a more controlled function of the screw rotation. The plug 1902 can be made from a combination of Polyoxymethylene plastic and other substances (e.g., polytetrafluoroethylene, which is known by the trade name of Teflon™) to adjust the friction factor. For example Delrin 150™ is a product made by the DuPont Corporation that has a coefficient of friction, against steel, of around 0.19. To develop a release torque of, say, 36 inches with a shaft diameter of 3/16", would require a Delrin pressure of 400 psi, requiring the use of a set of 4 washers in series to create this pressure within the normal linear range of such springs less than ½ inch in diameter.

The Lever 1307 may be equipped with a tab 1907 made from polytetrafluoroethylene (e.g., Teflon). The device is installed under the existing seat assembly such that the tab 1907 rests against the bottom of the seat, allowing the relative position of the lever 1307 contact with the seat to slide, in response to any misalignment of the centers of rotation of the device and the seat itself. In at least one embodiment of the invention, the height of the device center of rotation is about 0.75 inches above the base 1100 to match the usual standard height of the seat center of rotation. In an exemplary embodiment of the invention, the lever 1307 is equipped with a magnet and a paste-on metal decal that automatically sticks to the underside of the seat. The decal assures that when the device is commanded to lower the seat, the seat will follow the lever 1307 in the downward direction, kept in contact by the attractive force of the magnet and the paste-on metal decal. The attractive force of the magnet to metal does not preclude sliding of the contact between them, since the magnetic force only has an influence on the friction of the contact, proportional to the normal force, slightly increased by the magnetic attraction.

In an alternate embodiment, contact between the seat and the lever 1307 can be maintained by an internal drive system stop, that prevents the seat from reaching a vertical angle greater than, for example, 70 to 80 degrees. This allows gravity to provide the force necessary to keep the seat and lever 1307 in contact as the lever 1307 is commanded to lower. In another alternate embodiment, a small flexible plastic lanyard is connected to the seat and the lever 1307 to assure that the seat follows the lever 1307 downward. The lanyard may be affixed to the bottom of the seat via a self contained sticky surface.

Figure 22:
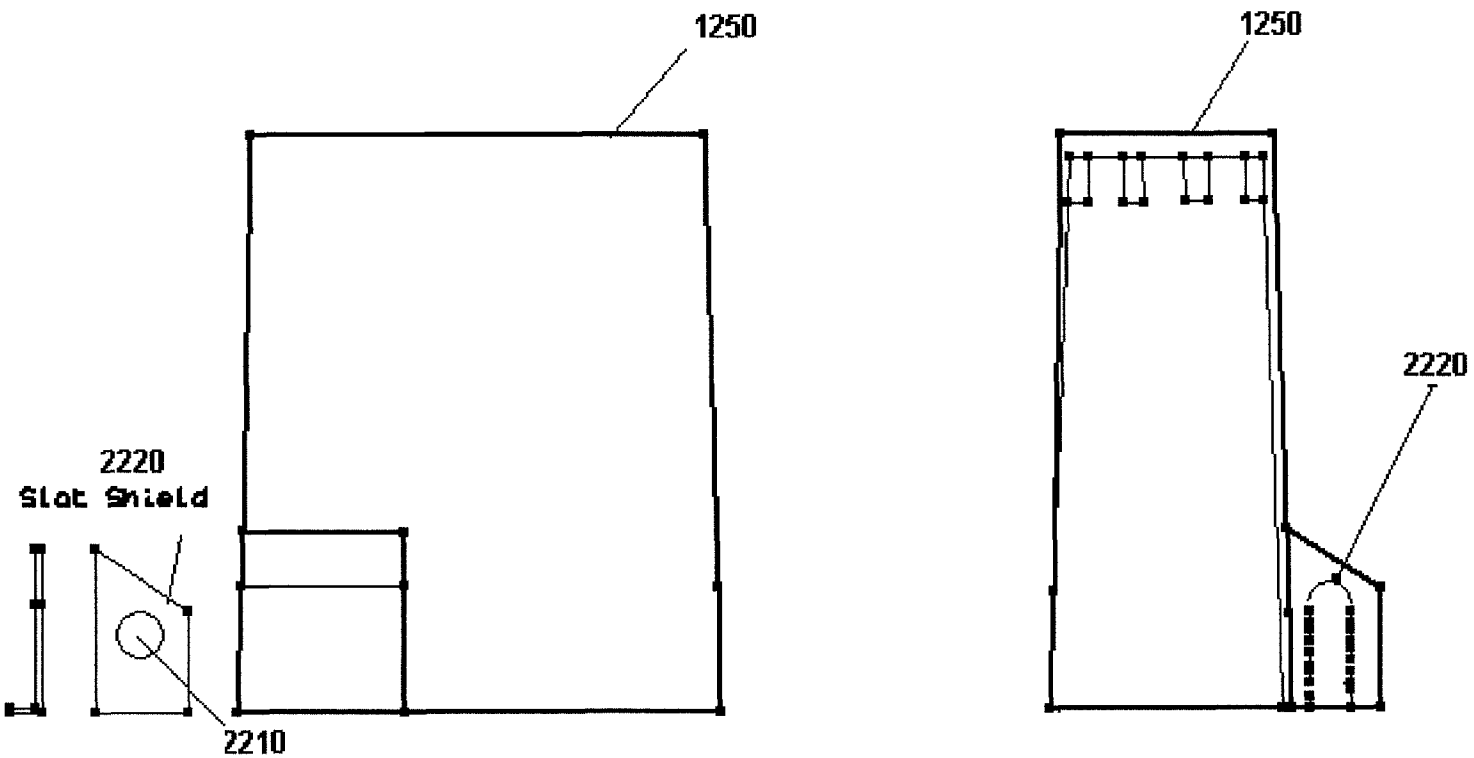
FIG. 22 illustrates the outer case of the device according to an exemplary embodiment of the invention.

FIG. 22 illustrates the outer case 1250 according to an exemplary embodiment of the invention. Referring to FIG. 22, there are no openings in the case, except for an opening 2210 in a slot shield/guard 2220 for the output shaft. The guard 2220 prevents the entry of liquids into the interior of the device, is mounted on the output shaft, but is restrained from turning as the output shaft turns by its interference with the base 1150.

In at least one embodiment of the present invention, the case 1250 is sized to fit into a space of about 3.75 inches. The output shaft and the lever 1307 are not restricted from being in line with the seat center of rotation, which in at least one embodiment is about 0.375 inches behind the back of the seat, underneath which the lever 1307 extends. In at least one embodiment of the invention, the distance behind the seat center of rotation, that the water tank's front is located is about 2.5 inches. For example, in certain toilets, a case depth dimension larger than about 3 inches may encounter interference with the water tank, preventing its installation. In at least one embodiment of the invention, the device is within the plan view dimensions of 3.75 by 3 inches. In at least one exemplary embodiment of the invention, the height of the device is 5 inches or less.

It is desirable that the outer case 1250 of the device have no openings of any kind that would permit the entry of liquid into the interior, which could compromise the integrity of the electronic components, the batteries, the motor, and the gear mechanism. Normally, in devices which utilize PIR sensing to activate their function, a window is provided to allow entry of IR signals at very low attenuation. Such windows are normally sealed, but not completely impervious to liquids. Further, light entering the window may be attenuated. Fresnel lenses are thin enough to fit into the location between the outer case 1250 and the PIR sensor 1101. However, an independent element such as a conventional Fresnel lens, presents two additional surfaces which cause reflection of such energy, the internal surface of the case and the upper surface of the Fresnel lens. According to an exemplary embodiment of the invention, this loss of signal can be avoided by designing a Fresnel lens that is embossed onto the internal surface of the case 1250.

Since high resolution imaging is not necessary, which is normally the function of a Fresnel lens, it is only necessary to focus as much of this energy as possible on the IR sensing element. Accordingly, the lens designed to be embossed on the internal surface of the case can be of a low resolution, so long as its dispersion is of an order of magnitude of the width of the sensitive portion of the IR sensor. This reduces the number of Fresnel segments needed in the lens.

Figure 23:
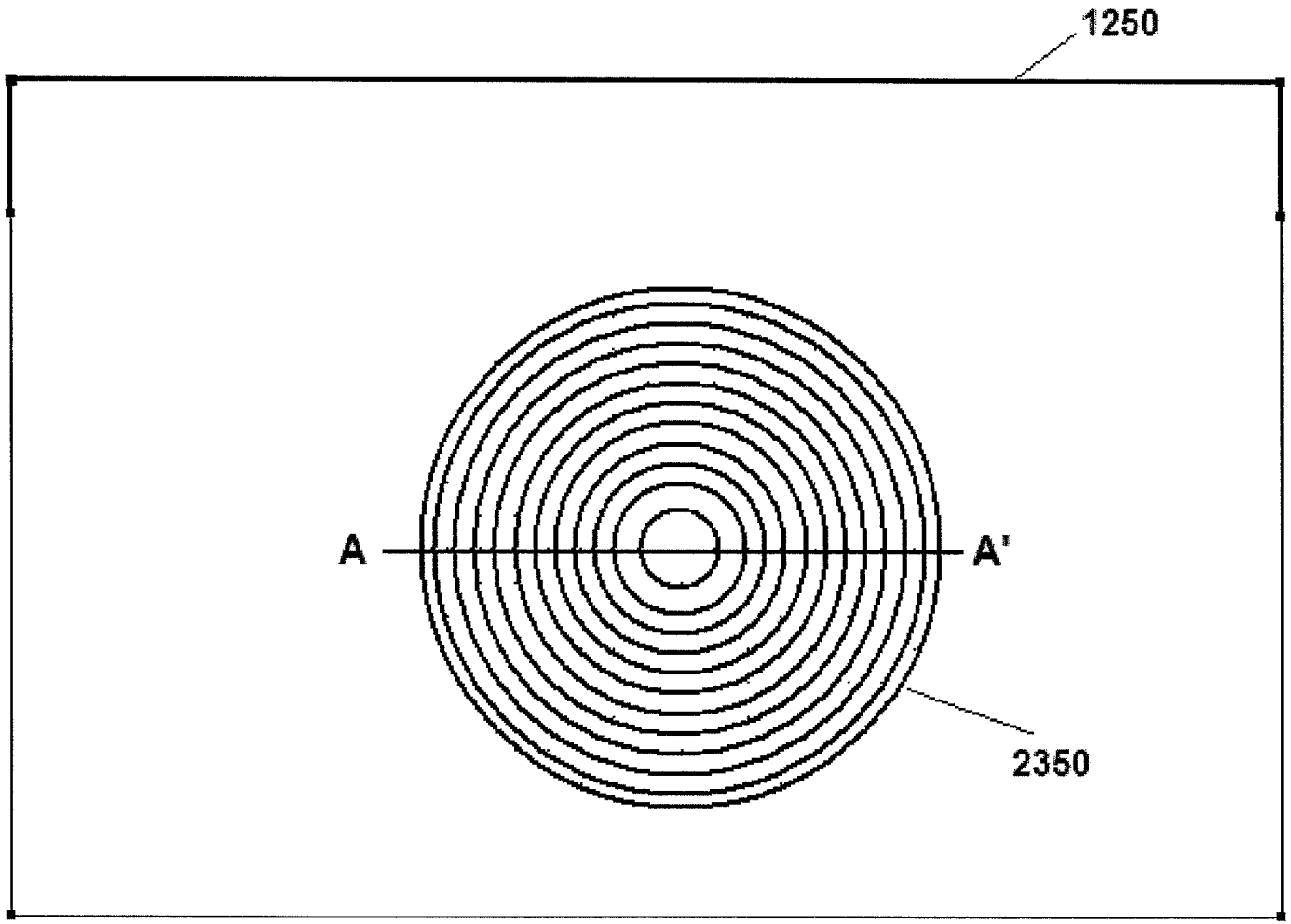
FIG. 23 illustrates the case of the device embossed with a lens according to an exemplary embodiment of the invention.

FIG. 23 illustrates an outer case 1250 of the device with a Fresnel lens 2350 embossed on the surface according to an exemplary embodiment of the present invention. In at least one embodiment of the invention, the lens 2350 is located on the top wall of the outer case 1250. The lens 2350 serves to gather the infrared signal impacting the surface of the case, and to concentrate it on the sensor itself, thus overcoming the loss of signal normally encountered by the thickness of the case above the sensor. For example, the lens 2350 may be configured to focus vertical light (e.g., light from points above the device over the toilet seat, the light being incident at the lens in the top surface of the case at an angle perpendicular to the top surface) directly to the infrared sensor of the PIR Sensor 1101, and refract light other than the vertical light (e.g., light hitting the lens at angles other than an angle that is perpendicular to the top surface) away from the infrared sensor to prevent accidental triggering of the device. In another embodiment the lens 2350 is configured to focus all light entering within +5 or −5 degrees of perpendicular to the sensor 1101 and refract light away from the sensor entering at other angles.

In at least one exemplary embodiment of the invention, the lens 2350 is located in the geometric center of the top wall of the outer case 1250. In at least one embodiment of the invention, the diameter of the lens 2350 is about 0.75 inches. The outer case 1250 having the top surface embossed with the lens 2350 may be made by using a mold having a corresponding surface with flat portions for regions surrounding the lens and segment portions corresponding to the segments of the lens. The focus point of the 2350 may be concentrated on the region of space directly above the device and its internal sensor, which requires the user to wave an object (e.g., their hand) above this space to activate operation. Without this focused region, any casual movement by a person near or on the toilet could accidentally activate the lifting or lowering function.

Figure 24:
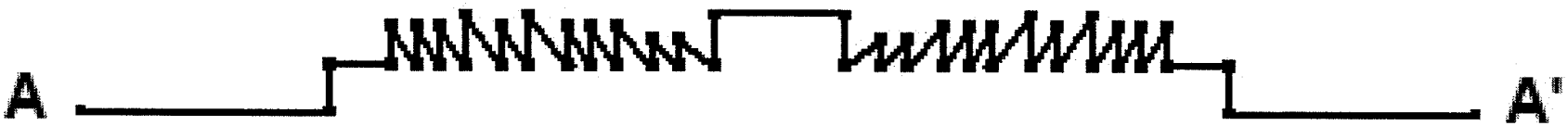
FIG. 24 illustrates a cross section through a line A-A' of the lens of FIG. 23 according to an exemplary embodiment of the invention.

FIG. 24 illustrates a cross section along line A-A' of the lens 2350 (e.g., around 0.75 inches in diameter), which is positioned above the location of the internal PIR sensor (not shown). Note that the segments of the lens shown in FIG. 24 are not drawn to scale. Table 1 is provided below and represents an exemplary embodiment of the lens 2350.

TABLE 1

| Radius | Angle | Depth | Net Depth | # of Cuts |
|---|---|---|---|---|
| 0 | 0 | 0 | | |
| 0.01 | 0 | 0 | | |
| 0.02 | 0 | 0 | | |
| 0.03 | 0 | 0 | | |
| 0.04 | 0 | 0 | | |
| 0.05 | 0 | 0 | 0.05 | 1 |
| 0.06 | 6 | 0.001051 | | |
| 0.07 | 6 | 0.001051 | | |
| 0.08 | 6 | 0.001051 | | |
| 0.09 | 6 | 0.001051 | 0.004204169 | 1 |
| 0.1 | 9.4 | 0.001655 | | |
| 0.11 | 9.4 | 0.001655 | | |
| 0.12 | 9.4 | 0.001655 | 0.004966468 | 1 |
| 0.13 | 11.7 | 0.002071 | | |
| 0.14 | 11.7 | 0.002071 | | |
| 0.15 | 11.7 | 0.002071 | 0.006212701 | 1 |
| 0.16 | 14 | 0.002493 | | |
| 0.17 | 14 | 0.002493 | | |
| 0.18 | 14 | 0.002493 | 0.00747984 | 1 |
| 0.19 | 16.1 | 0.002886 | | |
| 0.2 | 16.1 | 0.002886 | | |
| 0.21 | 16.1 | 0.002886 | 0.008659055 | 1 |
| 0.22 | 18.1 | 0.003269 | | |
| 0.23 | 18.1 | 0.003269 | | |
| 0.24 | 18.1 | 0.003269 | 0.009805511 | 1 |
| 0.25 | 20 | 0.00364 | | |
| 0.26 | 20 | 0.00364 | | |
| 0.27 | 20 | 0.00364 | 0.010919107 | 1 |
| 0.29 | 21.8 | 0.004 | | |
| 0.3 | 21.8 | 0.004 | 0.011999144 | 1 |
| 0.31 | 23.4 | 0.004327 | | |
| 0.32 | 23.4 | 0.004327 | | |
| 0.33 | 23.4 | 0.004327 | 0.012982159 | 1 |
| 0.34 | 24.9 | 0.004642 | | |
| 0.35 | 24.9 | 0.004642 | | |
| 0.36 | 25.3 | 0.004727 | 0.014010669 | 1 |
| 0.37 | 26 | 0.004877 | | |
| 0.38 | 26 | 0.004877 | 0.009754652 | 1 |
| 0.39 | 26.9 | 0.005073 | | |
| 0.4 | 26.9 | 0.005073 | 0.010146579 | 1 |

However, the lens 2350 may be embodied in various other ways, as the above Table 1 merely provides one example of how the lens could be implemented. Referring to Table 1, the radius column lists a distance from the center of the lens 2350 along line A-A', and assuming a cut is present at the listed radius, the angle column lists the angle of the cut, dept column lists the dept of the cut, and the net depth lists the net depth of the cut.

Figure 26:
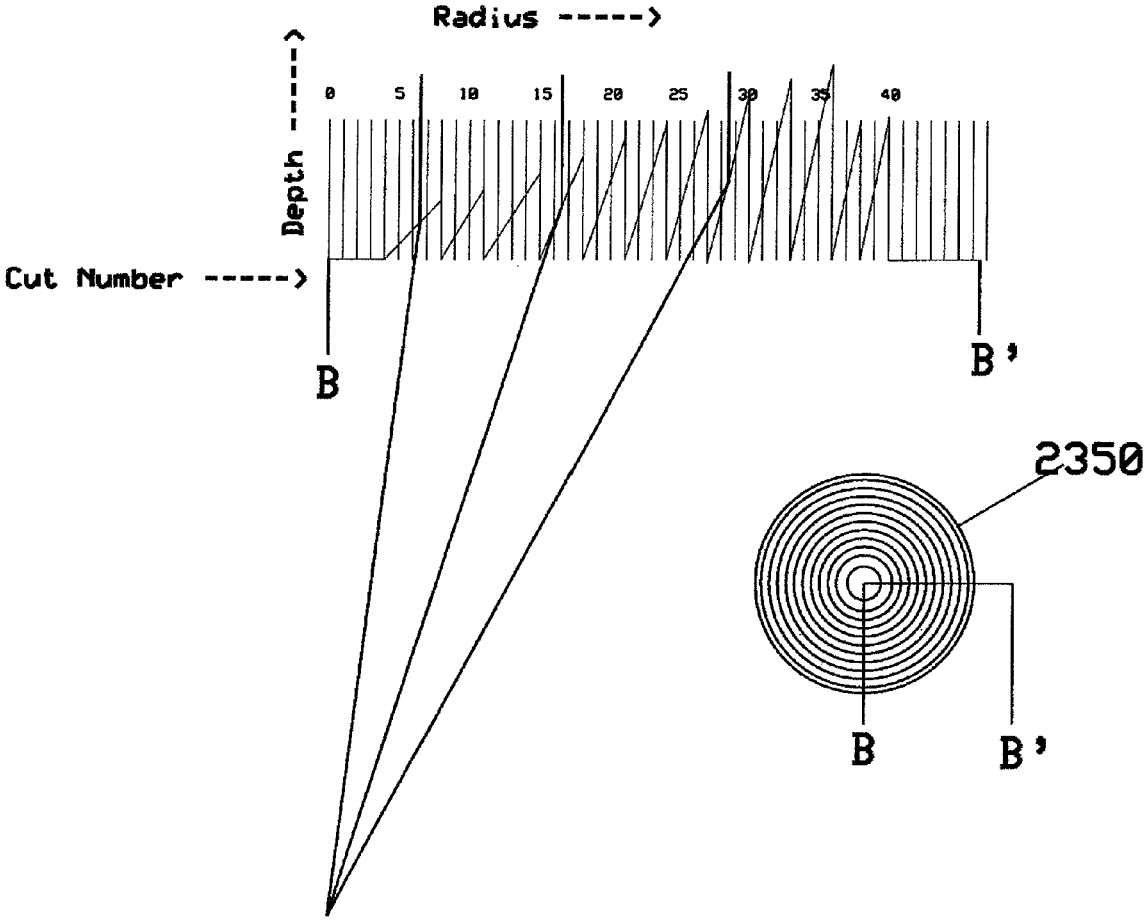
FIG. 26 illustrates an example of how light is processed by the lens of FIG. 25.

FIG. 25 illustrates a cross section of the lens 2350 along line B-B', according to an exemplary embodiment of the invention. The segments 2510 become steeper and longer as one moves away from the center of the lens. While FIG. 25 illustrates the first region has 10 segments, this is merely an examples, as the cross-section of the lens 2350 may include a greater or lesser number of segments. FIG. 26 illustrates how vertical light incident onto the surface of the lens 2350 is focused to a common point inside the case (e.g., an area of the infrared sensor of sensor 1101).

Please note that use of a spur gear and pinion gear as described above is merely an example, and the invention is not limited to use of any particular gear type or gear type combination. For example, whenever a spur gear is used above, it could be replaced with various other types of gears (e.g., a pinion gear), and whenever a pinion gear is used above, it could be replaced with various other types of gears (e.g., a spur gear).

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the disclosure.

What is claimed is:

1. An apparatus configured to lift and lower a seat assembly of a toilet, the apparatus comprising:

a case that is configured to be mounted to the toilet using existing mounting bolts of the seat assembly, wherein the case comprises:

a motion sensor that outputs a detection signal in response to observed motion;

a motor assembly comprising a motor driving unit and a motor, wherein the motor driving unit is configured to drive a shaft of the motor in a clockwise or a counter-clockwise direction based on receipt of a direction signal;

a first gear located on the shaft such that a rotation of the shaft of rotates the first gear;

a second gear located on an axle within the case and interfaced with the first gear such that a rotation of the first gear rotates the second gear;

an output shaft connected to a clutch coupled to a lever exiting the case such that rotation of the output shaft lifts or lowers the lever;

a wire rope wrapped around a hub of the second gear and a hub of the output shaft; and a micro-controller configured to send the direction signal to the motor driving unit indicating a direction of rotation based on the detection signal, wherein each hub includes an embedded flat ferrule and the wire rope is wrapped around the hubs through respective holes of the flat ferrules.

2. The apparatus of claim 1, further comprising a spiral spring located between the second gear and the axle such that a rotation of the second gear that lowers the lever winds the spring and an opposite rotation of the second gear that raises the lever unwinds the spring.

3. The apparatus of claim 1, wherein a bottom of the case includes a base plate having a first slot and a second slot, the slots spaced apart from one another to correspond to a distance between mounting holes of the toilet to receive the existing mounting bolts.

4. The apparatus of claim 3, wherein the base plate includes an extension between the slots that extends away from the front edge of the base plate and the case is attached to the base plate such that a back edge of a bottom surface of the case is flush with a back edge of the base plate and a front edge of the bottom surface of the case is flush with a front edge of the extension.

5. The apparatus of claim 3, further comprising a battery case housing a battery, wherein the micro-controller is affixed to the inside top surface of case and a first magnet connects the battery case to the microcontroller.

6. The apparatus of claim 5, further comprising a battery mounting plate, wherein the motor assembly is mounted between the base plate and the battery mounting plate, and the battery mounting plate is connected to a bottom surface of the battery case by a second magnet.

7. The apparatus of claim 1, wherein the top side of the case is plastic and the top side is embossed with a Fresnel lens.

8. The apparatus of claim 7, wherein segments of the lens are configured to focus incident light entering the lens at a first angle substantially perpendicular to the top side to a region of the motion sensor and refract light away from that region that enters the lens at angles different from the first angle.

9. The apparatus of claim 8, wherein segments of the lens become steeper and longer as one moves from the center of the lens towards the outside of the lens.

10. The apparatus of claim 1, wherein the micro-controller is configured to store a selected one of a default up and down position and automatically return the seat to the default position a predefined period after the micro-controller completes a lifting or lowering of the toilet seat when a current position of the toilet differs from the default position.

11. The apparatus of claim 1, further comprising:

a battery; and a voltage booster boosting a voltage of the battery, and providing a boosted voltage to the microcontroller and to the motor driving unit.

12. The apparatus of claim 11, wherein the micro-controller periodically enables the voltage booster for a first period and disables the voltage booster for a second period based on a comparison of a measured lifting or lowering period of the seat against a predefined time period.

13. The apparatus of claim 1, wherein the micro-controller monitors current output by the motor and sends a halt signal to the motor driving unit to halt operation of the motor when the current exceeds a predetermined threshold.

14. An apparatus configured to lift and lower a seat assembly of a toilet, the apparatus comprising:

a case that is configured to be mounted to the toilet using existing mounting bolts of the seat assembly, wherein the case comprises:

a motion sensor that outputs a detection signal in response to observed motion;

a motor assembly comprising a motor driving unit and a motor, wherein the motor driving unit is configured to drive a shaft of the motor in a clockwise or a counter-clockwise direction based on receipt of a direction signal;

a first gear located on the shaft such that a rotation of the shaft of rotates the first gear;

a second gear located on an axle within the case and interfaced with the first gear such that a rotation of the first gear rotates the second gear;

an output shaft connected to a clutch coupled to a lever exiting the case such that rotation of the output shaft lifts or lowers the lever;

a wire rope wrapped around a hub of the second gear and a hub of the output shaft; and a micro-controller configured to send the direction signal to the motor driving unit indicating a direction of rotation based on the detection signal, wherein each hub includes an embedded clamp ring and the wire rope is wrapped around the hubs through respective holes of the clamp rings.

15. The apparatus of claim 14, wherein the hole of least one of the clamp rings is shaped as a pair overlapping circles or ellipses to allow two distinct loops of the wire rope to be fed therethough.

16. An apparatus configured to lift and lower a seat assembly of a toilet, the apparatus comprising:

a case that is configured to be mounted to the toilet using existing mounting bolts of the seat assembly, wherein the case comprises:

a motion sensor that outputs a detection signal in response to observed motion;

a motor assembly comprising a motor driving unit and a motor, wherein the motor driving unit is configured to drive a shaft of the motor in a clockwise or a counter-clockwise direction based on receipt of a direction signal;

a first gear located on the shaft such that a rotation of the shaft of rotates the first gear;

a second gear located on an axle within the case and interfaced with the first gear such that a rotation of the first gear rotates the second gear;

an output shaft connected to a clutch coupled to a lever exiting the case such that rotation of the output shaft lifts or lowers the lever;

a wire rope wrapped around a hub of the second gear and a hub of the output shaft; and a micro-controller configured to send the direction signal to the motor driving unit indicating a direction of rotation based on the detection signal, wherein the clutch surrounds the output shaft and a perimeter of the clutch around the output shaft includes a plastic plug.

17. The apparatus of claim 16, wherein the clutch includes a hole through to the plastic plug and a pressure screw is applied through the hole to apply pressure to the plug.

18. The apparatus of claim 16, wherein the plastic plug comprises Poloxymethylene.

19. An apparatus configured to lift and lower a seat assembly of a toilet, the apparatus comprising:

a case that is configured to be mounted to the toilet using existing mounting bolts of the seat assembly, wherein the case comprises:

a motion sensor that outputs a detection signal in response to observed motion;

a motor assembly comprising a motor driving unit and a motor, wherein the motor driving unit is configured to drive a shaft of the motor in a clockwise or a counter-clockwise direction based on receipt of a direction signal;

a first gear located on the shaft such that a rotation of the shaft of rotates the first gear;

a second gear located on an axle within the case and interfaced with the first gear such that a rotation of the first gear rotates the second gear;

an output shaft connected to a clutch coupled to a lever exiting the case such that rotation of the output shaft lifts or lowers the lever;

a wire rope wrapped around a hub of the second gear and a hub of the output shaft; and a micro-controller configured to send the direction signal to the motor driving unit indicating a direction of rotation based on the detection signal, wherein at least one of the hubs has a first channel and a second channel with a hole between the channels, and the wire rope is wrapped around the hubs such that a first loop of the wire rope passes through the first channel and a second loop of the wire rope distinct from the first loop passes though the second channel, and a screw is screwed into the hole to apply pressure to both loops.

* * * * *